US011526190B2

(12) United States Patent
Conte

(10) Patent No.: US 11,526,190 B2
(45) Date of Patent: Dec. 13, 2022

(54) APPARATUS AND METHOD FOR A BANDGAP REFERENCE

(71) Applicant: STMicroelectronics S.r.l., Agrate Brianza (IT)

(72) Inventor: Antonino Conte, Tremestieri Etneo (IT)

(73) Assignee: STMicroelectronics S.R.L., Agrate Brianza (IT)

( * ) Notice: Subject to any disclaimer, the term of this patent is extended or adjusted under 35 U.S.C. 154(b) by 0 days.

(21) Appl. No.: 16/868,799

(22) Filed: May 7, 2020

(65) Prior Publication Data

US 2021/0349489 A1 Nov. 11, 2021

(51) Int. Cl.
*G05F 3/26* (2006.01)

(52) U.S. Cl.
CPC ..... *G05F 3/267* (2013.01)

(58) Field of Classification Search
CPC ..... G05F 3/24–30
See application file for complete search history.

(56) References Cited

U.S. PATENT DOCUMENTS 6,060,874 A * 5/2000 Doorenbos ..... G05F 3/30 323/316
6,985,098 B2 1/2006 Lee
7,683,701 B2 3/2010 Georgescu et al.
8,330,445 B2 * 12/2012 Herbst ..... G05F 3/30 323/313
9,246,479 B2 1/2016 Lee
10,114,400 B2 * 10/2018 Lacy ..... H03F 3/45968
10,439,562 B2 10/2019 Tokuda et al.
2007/0252573 A1 * 11/2007 Tachibana ..... G05F 3/30 323/313
2009/0066313 A1 * 3/2009 Kimura ..... G05F 3/262 323/313
2009/0085651 A1 * 4/2009 Liu ..... G05F 3/30 327/539
2009/0284242 A1 * 11/2009 Motz ..... H03F 3/393 323/313
2011/0102049 A1 * 5/2011 Conte ..... H03F 3/347 327/307
2012/0212194 A1 * 8/2012 Tachibana ..... G05F 3/30 323/268
2014/0203794 A1 * 7/2014 Pietri ..... G05F 3/02 323/313
2017/0115684 A1 * 4/2017 Xu ..... H03F 3/45968
2018/0348805 A1 * 12/2018 Elsayed ..... G05F 1/468
2020/0278708 A1 * 9/2020 Tesch ..... G05F 3/262 323/313

FOREIGN PATENT DOCUMENTS

CN 101351757 A 1/2009
CN 215298057 U 12/2021

* cited by examiner

*Primary Examiner* — Fred E Finch, III
(74) *Attorney, Agent, or Firm* — Slater Matsil, LLP

(57) ABSTRACT

An apparatus includes a current mirror coupled to an output of an amplifier through control switches, a plurality of capacitors, each of which is coupled to a common node of a leg of the current mirror and a corresponding control switch, a first dipole coupled to a first input of an amplifier, a second dipole coupled to a second input of the amplifier, a third dipole coupled to an output of the apparatus configured to generate the bandgap reference voltage, and groups of switches coupled between the current mirror and the dipoles.

20 Claims, 19 Drawing Sheets

APPARATUS AND METHOD FOR A BANDGAP REFERENCE

TECHNICAL FIELD

The present invention relates generally to an apparatus and method for a bandgap reference.

BACKGROUND

The semiconductor industry has experienced rapid growth due to continuous improvements in the integration density of a variety of electronic components (e.g., transistors, diodes, resistors, capacitors, etc.). For the most part, this improvement in integration density has come from repeated reductions in minimum feature size, which allows more components to be integrated into a given area. As the demand for even smaller electronic devices such central processing unit (CPU) has grown recently, there has grown a need for reducing the voltage rating of semiconductor devices. The reduced supply voltage further demands an accurate voltage reference through which integrated circuits are capable of steadily operating under a variety of operating conditions.

Bandgap voltage reference generators are widely used in a variety of applications from analog and mixed signal circuits such as high precision comparators and A/D converters, to digital circuits such as dynamic random access memory (DRAMs) circuits and non-volatile memory circuits. Bandgap voltage references produce a stable voltage reference having a low sensitivity to temperature by generating voltages and/or currents having positive and negative temperature coefficients, and summing these positive and negative coefficients in a manner that creates a temperature stable voltage reference. Traditionally, bandgap voltage references are fabricated using bipolar devices. For example, by summing a signal related to the base-emitter voltage of a bipolar transistor having a voltage inversely proportional to temperature with a signal that is proportional to a difference between the base-emitter voltages of two bipolar transistors that have a voltage proportional to temperature, a temperature stable voltage can be produced.

FIG. 1 illustrates a schematic diagram of a bandgap reference. The bandgap reference 100 comprises a first dipole 111, a second dipole 112, a third dipole 113, an amplifier 102, a first transistor MP1, a second transistor MP2 and a third transistor MP3. The first transistor MP1, the second transistor MP2 and the third transistor MP3 are implemented as p-type transistors as shown in FIG. 1.

The first dipole 111 comprises a resistor RA and a first bipolar junction transistor (BJT) T1. As shown in FIG. 1, the base of the first BJT T1 is coupled to the collector of the first BJT T1. The resistor RA and the first BJT T1 are coupled in parallel between an inverting input of the amplifier 102 and ground. Throughout the description, the first dipole 111 may be alternatively referred to as DIPOLE_A.

The second dipole 112 comprises a resistor RB, a resistor RE and a second BJT T2. As shown in FIG. 1, the base of the second BJT T2 is coupled to the collector of the second BJT T2. The resistor RE and the second BJT T2 are coupled in series and further coupled in parallel with the resistor RB. The second dipole 112 is coupled between a non-inverting input of the amplifier 102 and ground. Throughout the description, the second dipole 112 may be alternatively referred to as DIPOLE_B.

The third dipole 113 comprises a resistor Ro coupled between the output VBG of the bandgap reference 100 and ground. Throughout the description, the third dipole 113 may be alternatively referred to as DIPOLE_OUT.

As shown in FIG. 1, the sources of transistors MP1, MP2 and MP3 are coupled to a same voltage potential VDD. VDD is a bias voltage. The gates of transistors MP1, MP2 and MP3 are coupled to a common node (the output of the amplifier 102). As such, the first transistor MP1, the second transistor MP2 and the third transistor MP3 form a current mirror. According to the operating principle of the current mirror, the current (ID1) flowing through the first transistor MP1, the current (ID2) flowing through the second transistor MP2, and the current (IBG) flowing through the third transistor MP3 are equal to each other. The inputs of the amplifier 102 are coupled to the drains of MP1 and MP2 respectively. The output of the amplifier 102 is coupled to the gates of MP1, MP2 and MP3 as shown in FIG. 1. This system configuration shown in FIG. 1 helps to maintain the drain voltage of MP1 is the same as that of MP2. This helps to achieve a better current matching of the drain currents of transistors MP1 and MP2.

In operation, the first BJT T1 is configured to generate a first base emitter voltage VBE1. The second BJT T2 is configured to generate a second base emitter voltage VBE2. A delta VBE (ΔVBE) is generated across the resistor RE. The current flowing through the resistor RE is proportional to absolute temperature (PTAT). Since the voltage across the resistor RB is equal to the voltage across the resistor RA, the current (IRB) flowing through the resistor RB is proportional to the first base emitter voltage VBE1. The current flowing through the resistor RB is complementary to absolute temperature (CTAT). The sum of the current flowing through RE and the current flowing through RB is equal to the current flowing through Ro. A bandgap reference voltage (VBG) is generated across Ro. By selecting the ratio of RB to RE, the temperature dependency of the CTAT current (RB) and the PTAT current (RE) can cancel out. As a result, the bandgap reference 100 is able to generate a temperature stable voltage at the node VBG.

SUMMARY

In accordance with an embodiment, an apparatus comprises a current mirror coupled to an output of an amplifier through control switches, a plurality of capacitors, each of which is coupled to a common node of a leg of the current mirror and a corresponding control switch, a first dipole coupled to a first input of an amplifier, a second dipole coupled to a second input of the amplifier, a third dipole coupled to an output of the apparatus configured to generate the bandgap reference voltage, and groups of switches coupled between the current mirror and the dipoles.

In accordance with another embodiment, a device comprises a first dipole coupled to a first transistor, a second transistor and a third transistor through a first group of switches, a second dipole coupled to the first transistor, the second transistor and the third transistor through a second group of switches, a third dipole coupled to the first transistor, the second transistor and the third transistor through a third group of switches, an amplifier having inputs coupled to the first dipole and the second dipole respectively, and a control apparatus coupled between an output of the amplifier and gates of the first transistor, the second transistor and the third transistor.

In accordance with yet another embodiment, a method comprises in a first step, configuring a first control apparatus coupled between the transistors and the dipoles such that a current flowing through the second transistor flows into the first dipole, a current flowing through the third transistor flows into the second dipole, and a current flowing through the first transistor flows the third dipole, in a second step, configuring the first control apparatus coupled between the transistors and the dipoles such that the current flowing through the third transistor flows into the first dipole, the current flowing through the first transistor flows into the second dipole, and the current flowing through the second transistor flows the third dipole, in a third step, configuring the first control apparatus coupled between the transistors and the dipoles such that the current flowing through the first transistor flows into the first dipole, the current flowing through the second transistor flows into the second dipole, and the current flowing through the third transistor flows the third dipole, and iterating the first step, the second step and the third step.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the various embodiments and are not necessarily drawn to scale.

DETAILED DESCRIPTION OF ILLUSTRATIVE EMBODIMENTS

The making and using of embodiments of this disclosure are discussed in detail below. It should be appreciated, however, that the concepts disclosed herein can be embodied in a wide variety of specific contexts, and that the specific embodiments discussed herein are merely illustrative and do not serve to limit the scope of the claims. Further, it should be understood that various changes, substitutions and alterations can be made herein without departing from the spirit and scope of this disclosure as defined by the appended claims.

The present disclosure will be described with respect to preferred embodiments in a specific context, namely a bandgap reference. The present disclosure may also be applied, however, to a variety of systems and applications that provide a stable voltage reference under various operating conditions. Hereinafter, various embodiments will be explained in detail with reference to the accompanying drawings.

Figure 1:
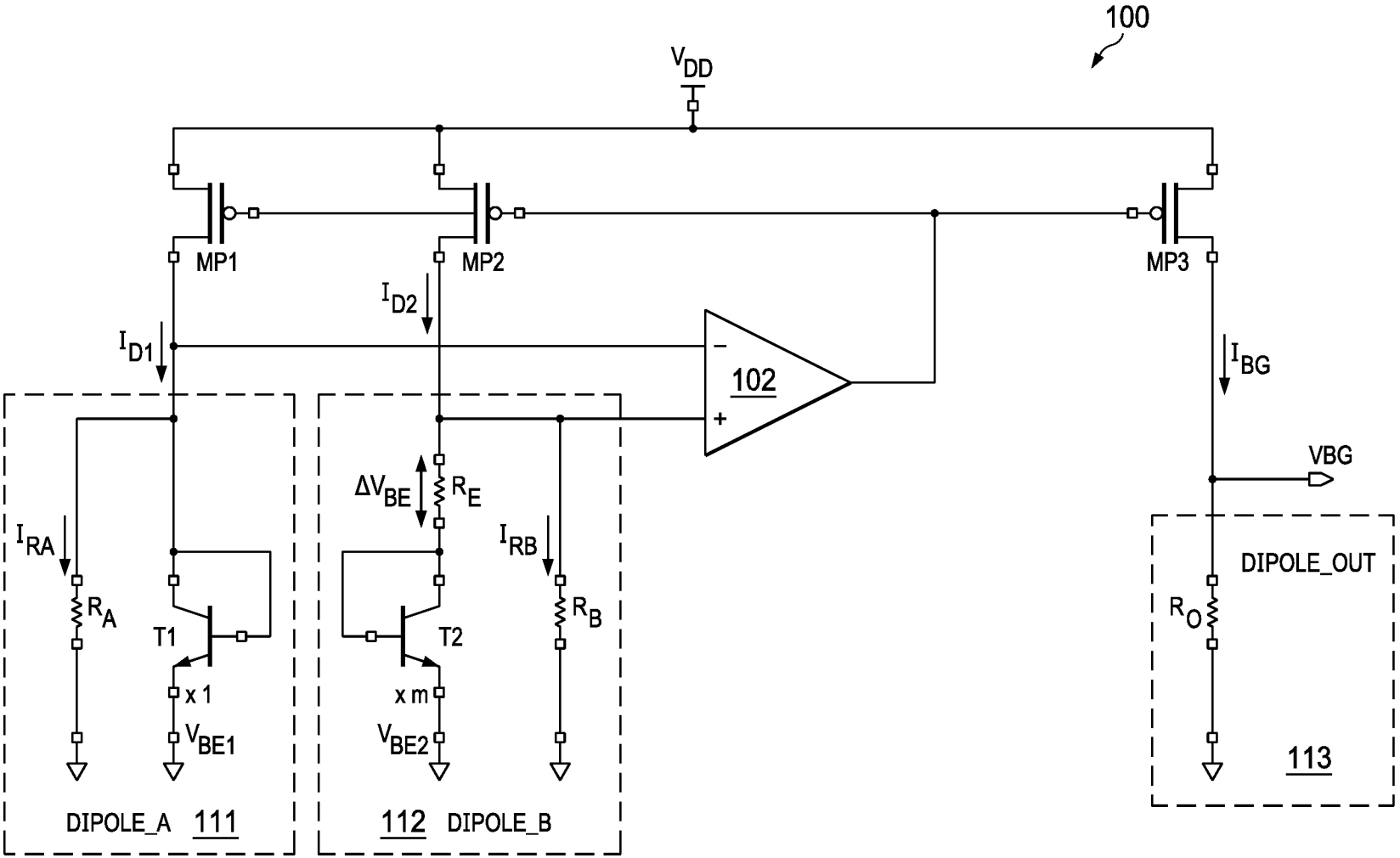
FIG. 1 (PRIOR ART)
FIG. 1 illustrates a schematic diagram of a bandgap reference.
Figure 2:
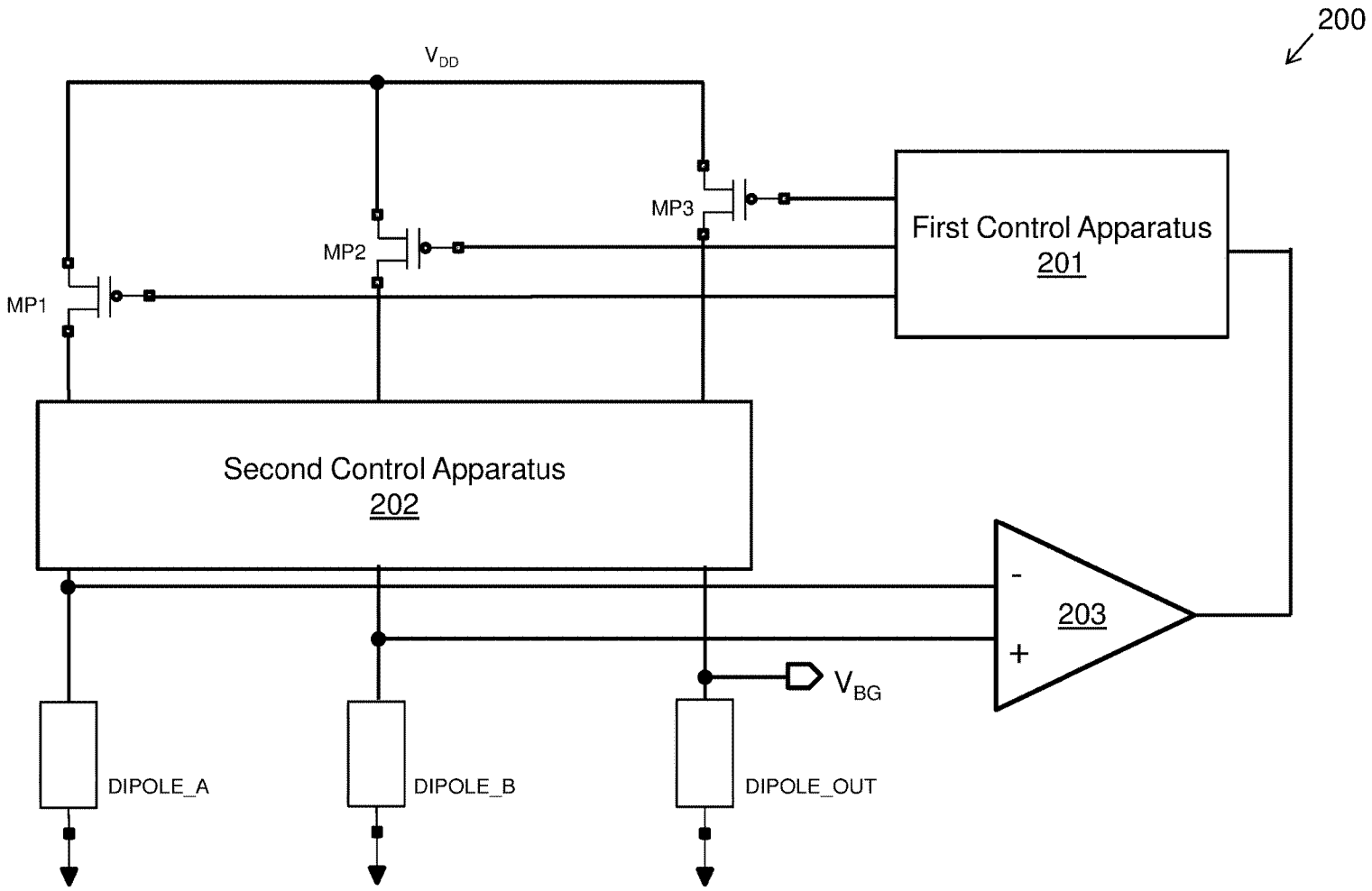
FIG. 2 illustrates a block diagram of a bandgap reference in accordance with various embodiments of the present disclosure.

FIG. 2 illustrates a block diagram of a bandgap reference in accordance with various embodiments of the present disclosure. The bandgap reference 200 comprises DIPOLE_A, DIPOLE_B, DIPOLE_OUT, a first control apparatus 201, a second control apparatus 202, an amplifier 203, a first transistor MP1, a second transistor MP2 and a third transistor MP3. The first transistor MP1, the second transistor MP2 and the third transistor MP3 are coupled between a bias voltage $V_{DD}$ and the second control apparatus 202. DIPOLE_A, DIPOLE_B and DIPOLE_OUT are coupled between the second control apparatus 202 and ground.

As shown in FIG. 2, the first transistor MP1, the second transistor MP2 and the third transistor MP3 are implemented as p-type transistors. This implementation is merely an example, which should not unduly limit the scope of the claims. One of ordinary skill in the art would recognize many variations, alternatives, and modifications.

As shown in FIG. 2, the output of the amplifier 203 is coupled to the gates of transistors MP1, MP2 and MP3 through the first control apparatus 201. In some embodiments, the first control apparatus 201 comprises a plurality of switches and capacitors. The plurality of switches is employed to control the connections between the gates of transistors MP1, MP2 and MP3 and the output of the amplifier 203. The plurality of capacitors is employed to store the drive signals applied to transistors MP1, MP2 and MP3. The detailed structure of the first control apparatus 201 will be described below with respect to FIG. 3.

The second control apparatus 202 is coupled between transistors MP1, MP2 and MP3, and the dipoles (DIPOLE_A, DIPOLE_B and DIPOLE_OUT). In some embodiments, the second control apparatus 202 comprises a plurality of groups of switches. More particularly, a first group of switches is coupled between DIPOLE_A and the drains of transistors MP1, MP2 and MP3. A second group of switches is coupled between DIPOLE_B and the drains of transistors MP1, MP2 and MP3. A third group of switches is coupled between DIPOLE_OUT and the drains of transistors MP1, MP2 and MP3. The detailed structure of the second control apparatus 202 will be described below with respect to FIG. 3.

The bandgap reference 200 is a current mode bandgap reference. In some embodiments, the current-voltage curve of DIPOLE_A and the current-voltage curve of DIPOLE_B cross at a non-zero current point. This non-zero current point is the equilibrium point of DIPOLE_A and DIPOLE_B. When the bandgap reference 200 is configured to operate at the equilibrium point of DIPOLE_A and DIPOLE_B, the offsets from the current mirror formed by transistors MP1, MP2 and MP3 can be eliminated. The equilibrium point of DIPOLE_A and DIPOLE_B will be shown below with respect to FIGS. 5, 7 and 9.

The amplifier 203 is equipped with a suitable offset cancellation apparatus. The offset cancellation apparatus is employed to reduce the offset of the amplifier 203, thereby improving the accuracy of the bandgap reference 200.

Transistors MP1, MP2 and MP3 form a current mirror. The offsets of this current mirror can be reduced or eliminated by applying a convergence method to the bandgap reference 200. In particular, the convergence method forces DIPOLE_A and DIPOLE_B to operate at the equilibrium operating point of DIPOLE_A and DIPOLE_B. The offsets of the current mirror are compensated when DIPOLE_A and DIPOLE_B operate at the equilibrium operating point, thereby reducing the offsets of the current mirror.

In operation, the convergence control method is applied to the bandgap reference 200 through configuring the on/off of the switches of the first control apparatus 201 and the second control apparatus 202. More particularly, the currents flowing through the dipoles are rotated through an iteration process. The iteration process helps to find the equilibrium operating point of DIPOLE_A and DIPOLE_B. The detailed operating principle of the convergence control method will be described below with respect to FIGS. 4-10.

Figure 3:
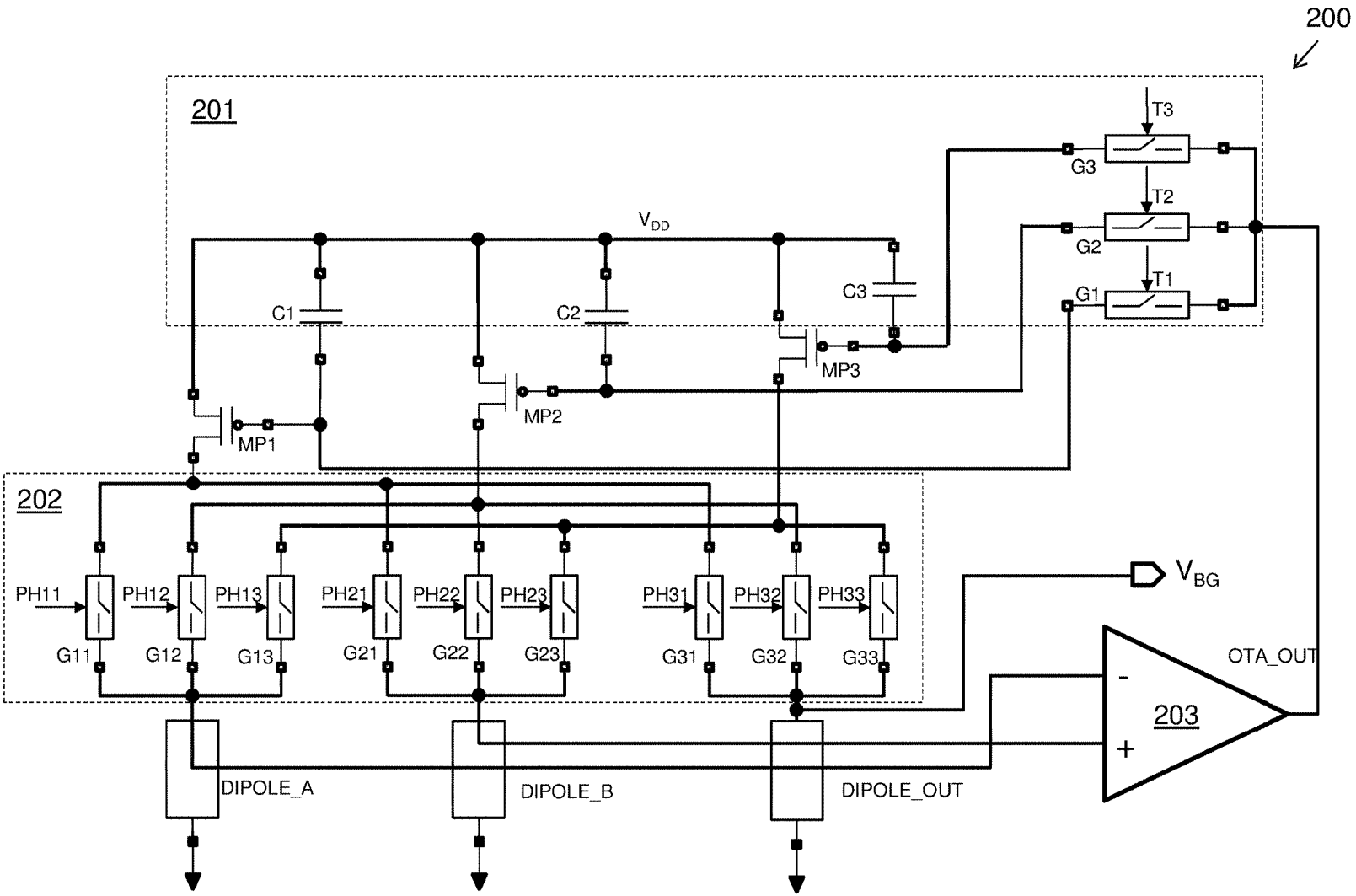
FIG. 3 illustrates a schematic diagram of the bandgap reference shown in FIG. 2 in accordance with various embodiments of the present disclosure.

FIG. 3 illustrates a schematic diagram of the bandgap reference shown in FIG. 2 in accordance with various embodiments of the present disclosure. Transistors MP1, MP2 and MP3 form a current mirror. The current mirror is coupled to an output of the amplifier 203 through control switches G1, G2 and G3. In particular, the gate of MP1 is coupled to the output of the amplifier 203 through switch G1. The gate of MP2 is coupled to the output of the amplifier 203 through switch G2. The gate of MP3 is coupled to the output of the amplifier 203 through switch G3.

As shown in FIG. 3, the switch G1 is controlled by a control signal T1. The switch G2 is controlled by a control signal T2. The switch G3 is controlled by a control signal T3. Control signals T1, T2 and T3 are generated by suitable convergence logic apparatuses such as the convergence logic block described below with respect to FIG. 13.

The first control apparatus 201 further comprises a plurality of capacitors C1, C2 and C3. Each of the plurality of capacitors is coupled to a common node of a leg of the current mirror and a corresponding control switch. The current mirror comprises three legs. The capacitor C1 is coupled to a common node of the first leg (MP1) and the switch G1. The capacitor C2 is coupled to a common node of the second leg (MP2) and the switch G2. The capacitor C3 is coupled to a common node of the third leg (MP3) and the switch G3. More particularly, as shown in FIG. 3, the capacitor C1 is coupled between $V_{DD}$ and the gate of transistor MP1. The capacitor C2 is coupled between $V_{DD}$ and the gate of transistor MP2. The capacitor C3 is coupled between $V_{DD}$ and the gate of transistor MP3.

DIPOLE_A is coupled between a first input of the amplifier 203 and ground. The first input is an inverting input of the amplifier 203. Throughout the description, DIPOLE_A may be alternatively referred to as a first dipole. DIPOLE_B is coupled between a second input of the amplifier 203 and ground. The second input is a non-inverting input of the amplifier 203. Throughout the description, DIPOLE_B may be alternatively referred to as a second dipole. DIPOLE_OUT is coupled between an output of the bandgap reference 200 and ground. The output ($V_{BG}$) of the bandgap reference 200 is configured to generate a temperature stable reference voltage. Throughout the description, DIPOLE_OUT may be alternatively referred to as a third dipole.

The second control apparatus 202 comprises three groups of switches. A first group of switches comprises a first switch G11, a second switch G12 and a third switch G13. A first terminal of the first switch G11, a first terminal of the second switch G12 and a first terminal of the third switch G13 are coupled together and further coupled to DIPOLE_A. A second terminal of the first switch G11 is coupled to the drain of MP1. A second terminal of the second switch G12 is coupled to the drain of MP2. A second terminal of the third switch G13 is coupled to the drain of MP3.

A second group of switches comprises a fourth switch G21, a fifth switch G22 and a sixth switch G23. A first terminal of the fourth switch G21, a first terminal of the fifth switch G22 and a first terminal of the sixth switch G23 are coupled together and further coupled to DIPOLE_B. A second terminal of the fourth switch G21 is coupled to the drain of MP1. A second terminal of the fifth switch G22 is coupled to the drain of MP2. A second terminal of the sixth switch G23 is coupled to the drain of MP3.

A third group of switches comprises a seventh switch G31, an eighth switch G32 and a ninth switch G33. A first terminal of the seventh switch G31, a first terminal of the eighth switch G32 and a first terminal of the ninth switch G33 are coupled together and further coupled to DIPOLE_OUT. A second terminal of the seventh switch G31 is coupled to the drain of MP1. A second terminal of the eighth switch G32 is coupled to the drain of MP2. A second terminal of the ninth switch G33 is coupled to the drain of MP3.

As shown in FIG. 3, the switch G11 is controlled by a control signal PH11. The switch G12 is controlled by a control signal PH12. The switch G13 is controlled by a control signal PH13. The switch G21 is controlled by a control signal PH21. The switch G22 is controlled by a control signal PH22. The switch G23 is controlled by a control signal PH23. The switch G31 is controlled by a control signal PH31. The switch G32 is controlled by a control signal PH32. The switch G33 is controlled by a control signal PH33. Control signals PH11, PH12, PH13, PH21, PH22, PH23, PH31, PH32 and PH33 are generated by suitable convergence logic apparatuses such as the convergence logic block described below with respect to FIG. 13.

In some embodiments, DIPOLE_A comprises a first resistor and a first diode-connected bipolar transistor coupled in parallel. DIPOLE_B comprises a second resistor and a second diode-connected bipolar transistor coupled in serious and further coupled in parallel with a third resistor. DIPOLE_OUT comprises a fourth resistor. In some embodiments, a transistor area of the second diode-connected bipolar transistor is N times greater than a transistor area of the first diode-connected bipolar transistor. N is a predetermined integer greater than 1.

In some embodiments, a current flowing through the second resistor is proportional to a difference between a first base-emitter voltage of the first diode-connected bipolar transistor and a second base-emitter voltage of the second diode-connected bipolar transistor. A current flowing through the second resistor is proportional to absolute temperature. A current flowing through the third resistor is proportional to the first base-emitter voltage of the first diode-connected bipolar transistor. The current flowing through the third resistor is complementary to absolute temperature. Through an appropriate choice of the resistors, the sum of currents of these two may cancel the contribution of the temperature factor so as to obtain a current independent of the temperature. Such a current independent of the temperature flows through the resistor of DIPOLE_OUT, and generates a temperature stable reference voltage.

In operation, a convergence control method is applied to the bandgap reference 200 through configuring the on/off of the switches of the first control apparatus 201 and the second control apparatus 202. The convergence control method comprises an initial step and a plurality of iteration steps. The iteration steps repeat until the equilibrium operating point of DIPOLE_A and DIPOLE_B has been obtained. The initial step may be alternatively referred to as a startup phase of the bandgap reference 200. The initial step will be described below with respect to FIGS. 4-5. The first step of the plurality of iteration steps of the convergence control method will be described below with respect to FIGS. 6-7. The second step of the plurality of iteration steps of the convergence control method will be described below with respect to FIGS. 8-9.

Figure 4:
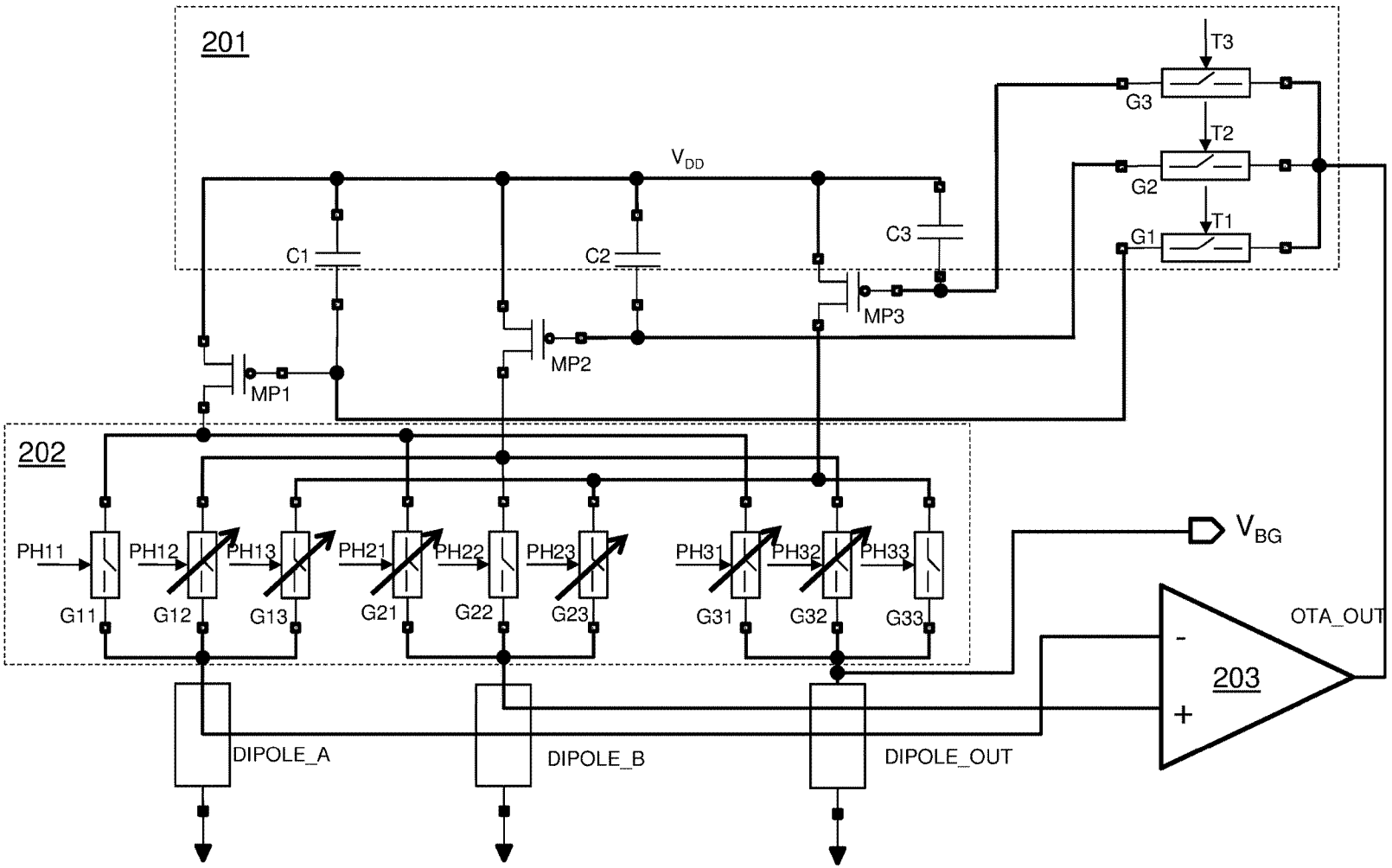
FIG. 4 illustrates a system configuration of the bandgap reference operating in an initial step in accordance with various embodiments of the present disclosure.

FIG. 4 illustrates a system configuration of the bandgap reference operating in an initial step in accordance with various embodiments of the present disclosure. During the initial step, switches G12, G13, G21, G23, G31 and G32 are turned off as indicated by the arrows placed on top of their respective symbols. Also in the initial step, switches G11, G22, G33, G1, G2 and G3 are turned on. Since G11 is turned on, the current flowing through MP1 flows into DIPOLE_A. Likewise, since G22 is turned on, the current flowing through MP2 flows into DIPOLE_B. Since G33 is turned on, the current flowing through MP3 flows into DIPOLE_OUT. Since G1, G2 and G3 are turned on, the output of the amplifier 203 is configured to drive the gates of transistors MP1, MP2 and MP3.

Figure 5:
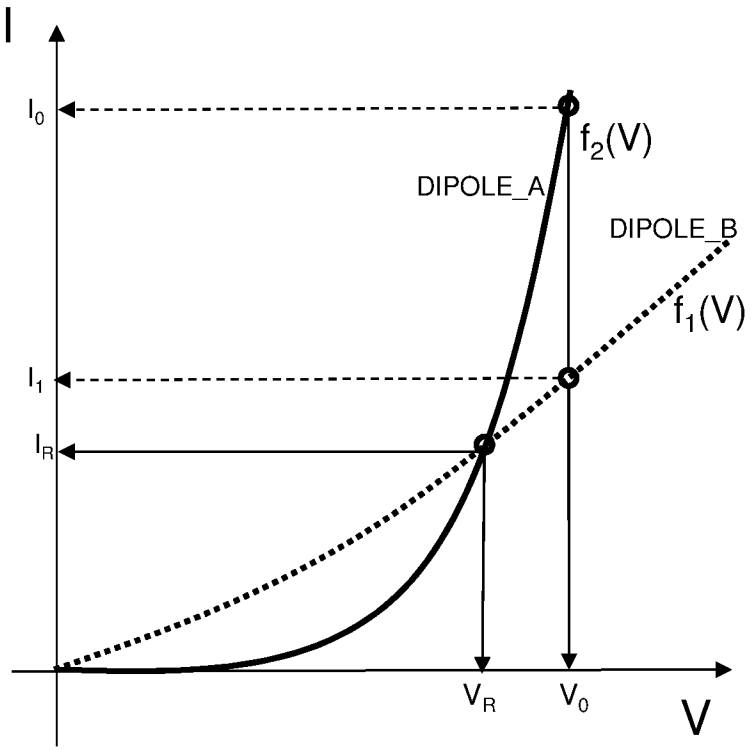
FIG. 5 illustrates current-voltage curves of the dipoles of the bandgap reference operating in the initial step in accordance with various embodiments of the present disclosure.

FIG. 5 illustrates current-voltage curves of the dipoles of the bandgap reference operating in the initial step in accordance with various embodiments of the present disclosure. The solid curve represents the current-voltage curve (f2(V)) of DIPOLE_A. The dotted curve represents the current-voltage curve (f1(V)) of DIPOLE_B. The intersection ($I_R$ and $V_R$) of these two current-voltage curves is the equilibrium point of the bandgap reference 200.

According to the current-voltage curve of DIPOLE_A, the current flowing through DIPOLE_A is equal to I0. The voltage across DIPOLE_A is equal to V0. Since DIPOLE_A and DIPOLE_B are coupled to the two inputs of the amplifier 203 respectively, the voltage across DIPOLE_B is equal to the voltage across DIPOLE_A. As such, the voltage across DIPOLE_B is equal to V0. According to the current-voltage curve of DIPOLE_B, the current flowing through DIPOLE_B is equal to I1. As shown in FIG. 5, I0 is greater than I1.

Referring back to FIG. 4, since transistor MP2 is coupled to DIPOLE_B, the current flowing through transistor MP2 is equal to I1. I1 is a new operating current for DIPOLE_A. I1 will be switched to DIPOLE_A in the first step of the convergence control method.

Figure 6:
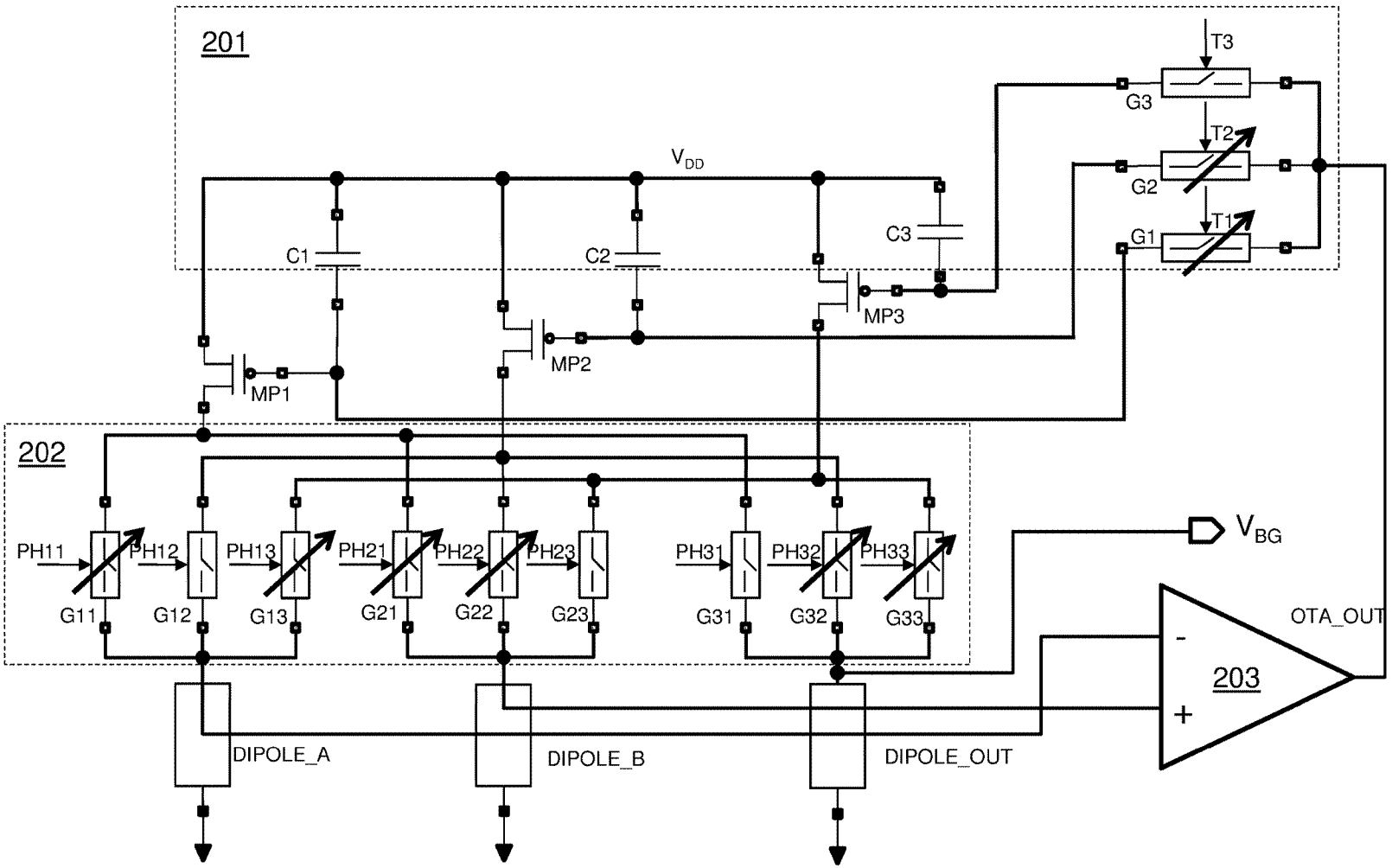
FIG. 6 illustrates a system configuration of the bandgap reference operating in a first step of the convergence control method in accordance with various embodiments of the present disclosure.

FIG. 6 illustrates a system configuration of the bandgap reference operating in a first step of the convergence control method in accordance with various embodiments of the present disclosure. During the first step of the convergence control method, switches G11, G13, G21, G22, G32, G33, G1 and G2 are turned off as indicated by the arrows placed on top of their respective symbols. Also in the first step of the convergence control method, switches G12, G23, G31 and G3 are turned on. Since G12 is turned on, the current flowing through transistor MP2 flows into DIPOLE_A. As described above with respect to FIG. 5, the current flowing through transistor MP2 is equal to I1. In the first step of the convergence control method, the current flowing through DIPOLE_A is equal to I1.

Likewise, since G23 is turned on, the current flowing through transistor MP3 flows into DIPOLE_B. Since G31 is turned on, the current flowing through transistor MP1 flows into DIPOLE_OUT. As described above with respect to FIG. 5, the current flowing through transistor MP1 is equal to I0. In the first step of the convergence control method, the current flowing through DIPOLE_OUT is equal to I0.

As shown in FIG. 6, since G1 and G2 are turned off, the output of the amplifier 203 is not used to drive the gates of transistors MP1 and MP2. The gate drive voltages of transistors MP1 and MP2 in the initial step are stored in capacitors C1 and C2 respectively. The output of the amplifier 203 is used to drive the gate of transistor MP3 as shown in FIG. 6.

Figure 7:
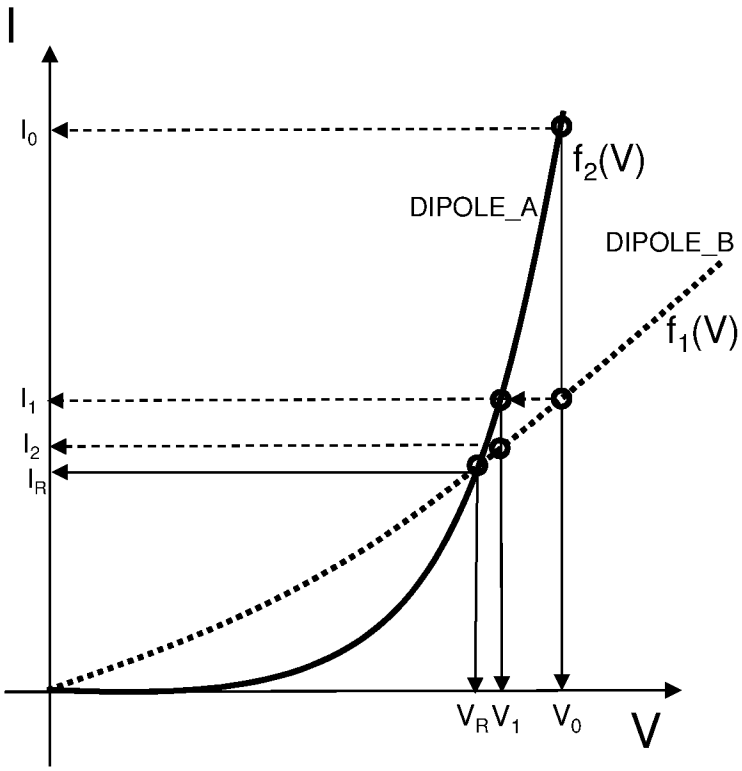
FIG. 7 illustrates current-voltage curves of the dipoles of the bandgap reference operating in the first step of the convergence control method in accordance with various embodiments of the present disclosure.

FIG. 7 illustrates current-voltage curves of the dipoles of the bandgap reference operating in the first step of the convergence control method in accordance with various embodiments of the present disclosure. The solid curve represents the current-voltage curve of DIPOLE_A. The dotted curve represents the current-voltage curve of DIPOLE_B.

As described above with respect to FIG. 6, the current flowing through transistor MP2 is equal to I1. Transistor MP2 is coupled to DIPOLE_A. As such, the current flowing through DIPOLE_A is equal to I1. According to the current-voltage curve of DIPOLE_A, the voltage across DIPOLE_A is equal to V1 as shown in FIG. 7. V1 is less than V0. Since DIPOLE_A and DIPOLE_B are coupled to the two inputs of the amplifier 203 respectively, the voltage across DIPOLE_B is equal to the voltage across DIPOLE_A. As such, the voltage across DIPOLE_B is equal to V1. According to the current-voltage curve of DIPOLE_B, the current flowing through DIPOLE_B is equal to I2. As shown in FIG. 7, I1 is greater than I2.

Referring back to FIG. 6, transistor MP3 is coupled to DIPOLE_B. The output of the amplifier 203 is used to drive the gate of MP3. In order to satisfy the current-voltage curve of DIPOLE_B, the amplifier 203 is configured such that the current flowing through transistor MP3 is equal to I2.

According to the convergence control method, I2 is a new operating current for DIPOLE_A. 12 will be switched to DIPOLE_A in the next step of the convergence control method.

Figure 8:
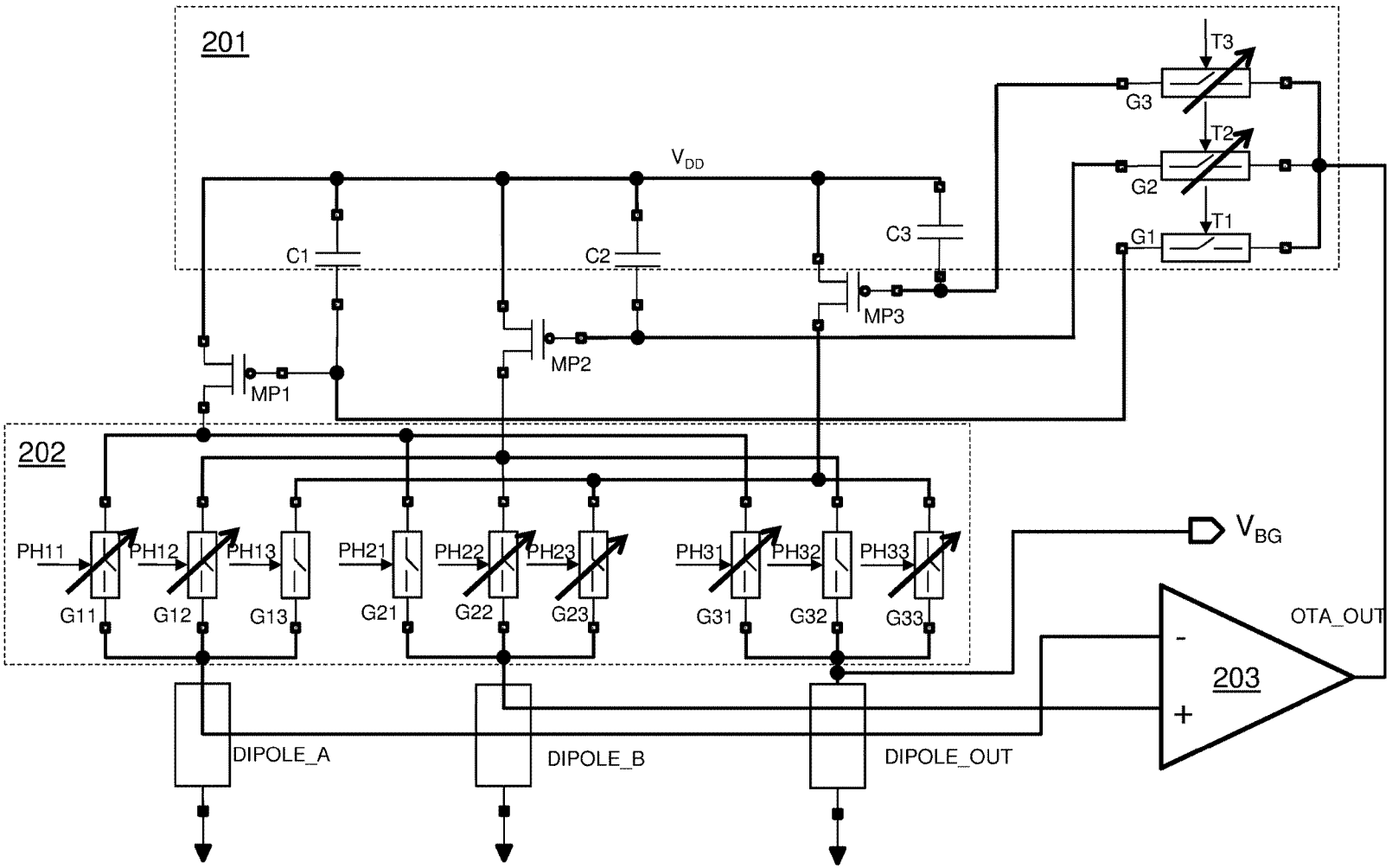
FIG. 8 illustrates a system configuration of the bandgap reference operating in a second step of the convergence control method in accordance with various embodiments of the present disclosure.

FIG. 8 illustrates a system configuration of the bandgap reference operating in a second step of the convergence control method in accordance with various embodiments of the present disclosure. During the second step of the convergence control method, switches G11, G12, G22, G23, G31, G33, G2 and G3 are turned off as indicated by the arrows placed on top of their respective symbols. Also in the second step of the convergence control method, switches G13, G21, G32 and G1 are turned on. Since G13 is turned on, the current flowing through transistor MP3 flows into DIPOLE_A. As described above with respect to FIG. 7, the current flowing through MP3 is equal to I2. In the second step of the convergence control method, the current flowing through DIPOLE_A is equal to I2.

Likewise, since G21 is turned on, the current flowing through transistor MP1 flows into DIPOLE_B. Since G32 is turned on, the current flowing through transistor MP2 flows into DIPOLE_OUT. As described above with respect to FIG. 7, the current flowing through MP2 is equal to I1. In the second step of the convergence control method, the current flowing through DIPOLE_OUT is equal to I1.

As shown in FIG. 8, since G2 and G3 are turned off, the output of the amplifier 203 is not used to drive the gates of transistors MP2 and MP3. The gate drive voltages of transistors MP2 and MP3 in the first step of the convergence control method are stored in capacitors C2 and C3 respectively. The output of the amplifier 203 is used to drive the gate of transistor MP1.

Figure 9:
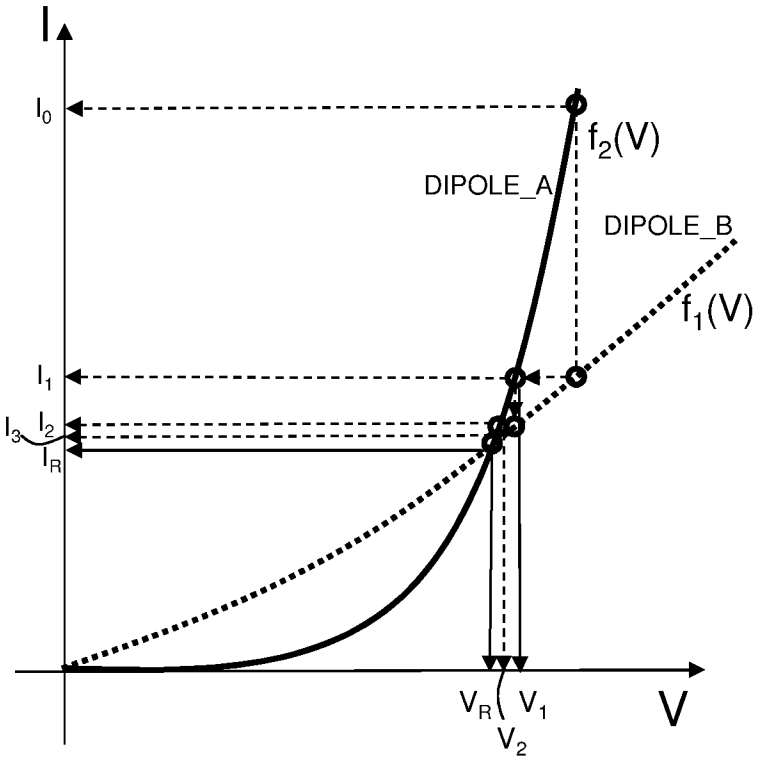
FIG. 9 illustrates current-voltage curves of the dipoles of the bandgap reference operating in the second step of the convergence control method in accordance with various embodiments of the present disclosure.

FIG. 9 illustrates current-voltage curves of the dipoles of the bandgap reference operating in the second step of the convergence control method in accordance with various embodiments of the present disclosure. The solid curve represents the current-voltage curve of DIPOLE_A. The dotted curve represents the current-voltage curve of DIPOLE_B.

As described above with respect to FIG. 8, the current flowing through transistor MP3 is equal to I2. Transistor MP3 is coupled to DIPOLE_A. As such, the current flowing through DIPOLE_A is equal to I2. According to the current-voltage curve of DIPOLE_A, the voltage across DIPOLE_A is equal to V2 as shown in FIG. 9. V2 is less than V1. Since DIPOLE_A and DIPOLE_B are coupled to the two inputs of the amplifier 203 respectively, the voltage across DIPOLE_B is equal to the voltage across DIPOLE_A. As such, the voltage across DIPOLE_B is equal to V2. According to the current-voltage curve of DIPOLE_B, the current flowing through DIPOLE_B is equal to I3. As shown in FIG. 7, I2 is greater than I3.

Referring back to FIG. 8, transistor MP1 is coupled to DIPOLE_B. The output of the amplifier 203 is used to drive the gate of transistor MP1. In order to satisfy the current-voltage curve of DIPOLE_B, the amplifier 203 is configured such that the current flowing through transistor MP1 is equal to I3.

According to the convergence control method, I3 is a new operating current for DIPOLE_A. I3 will be switched to DIPOLE_A in the next step of the convergence control method.

The convergence control method is applied to the bandgap reference 200 until the equilibrium operating point ($V_R$ and $I_R$) of DIPOLE_A and DIPOLE_B has been obtained. This is an iteration process. In order to avoid unnecessary repetition, the next few steps are summarized in Table 1 below.

Table 1 shows the current distribution in the bandgap reference under different steps of the convergence control method.

TABLE 1

| State | MP1 | Dipole A | MP2 | Dipole B | MP3 | Dipole O |
|---|---|---|---|---|---|---|
| Step 0 | I0 | I0 | I1 | I1 | Ix | Ix |
| Step 1 | I0 | I1 | I1 | I2 | I2 | I0 |
| Step 2 | I3 | I2 | I1 | I3 | I2 | I1 |
| Step 3 | I3 | I3 | I4 | I4 | I2 | I2 |
| Step 4 | I3 | I4 | I4 | I5 | I5 | I3 |
| Step 5 | I6 | I5 | I4 | I6 | I5 | I4 |
| Step 6 | I6 | I6 | I7 | I7 | I5 | I5 |

In Table 1, step 0 represents the initial step described above with respect to FIGS. 4-5. Step 1 represents the first step described above with respect to FIGS. 6-7. Step 2 represents the second step described above with respect to FIGS. 8-9. Steps 3-6 are subsequent steps executed after step 2. As described above, I0 is greater than I1, and I1 is greater than I2. Currents I0, I1, I2, I3, I4, I5 and I6 decrease in a sequential order.

As shown in Table 1, the current distribution pattern of steps 4-6 is the same as that of steps 1-3. In other words, an iteration process is employed to rotate the currents flowing through the three dipoles of the bandgap reference 200. The convergence control method applies this iteration process until the equilibrium point ($I_R$ and $V_R$) of the bandgap reference 200 has been achieved.

One advantageous feature of operating the bandgap reference 200 at the equilibrium point ($I_R$ and $V_R$) is the offsets from the current mirror (transistors MP1, MP2 and MP3) can be compensated so as to reduce the impacts from the offsets. More particularly, under the convergence control method described above, the transistors of the current mirror (e.g., MP1 and MP2) converge to the same operating current point ($I_R$ and $V_R$). The corresponding gate drive voltages of the transistors of the current mirror are stored in the gate capacitors (e.g., C1 and C2). The stored gate drive voltages drive the transistors of the current mirror to operate at the equilibrium point ($I_R$ and $V_R$) although the current mirror has offsets. As such, operating at the equilibrium point ($I_R$ and $V_R$) helps to reduce the impact from the offsets of the current mirror.

Figure 10:
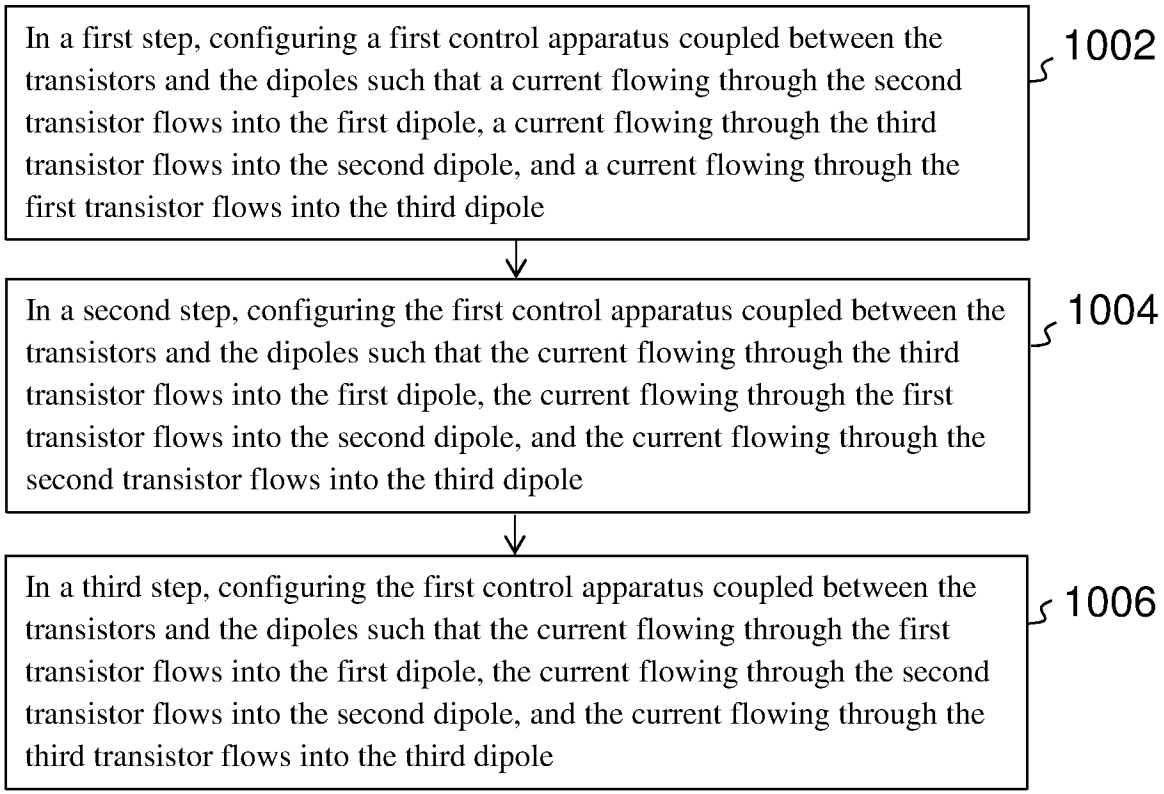
FIG. 10 illustrates a flow chart of a method for controlling the bandgap reference shown in FIG. 2 in accordance with various embodiments of the present disclosure.

FIG. 10 illustrates a flow chart of a method for controlling the bandgap reference shown in FIG. 2 in accordance with various embodiments of the present disclosure. This flow-chart shown in FIG. 10 is merely an example, which should not unduly limit the scope of the claims. One of ordinary skill in the art would recognize many variations, alternatives, and modifications. For example, various steps illustrated in FIG. 10 may be added, removed, replaced, rearranged and repeated.

The bandgap reference 200 comprises a current mirror, a first dipole, a second dipole and a third dipole. The current mirror comprises a first transistor, a second transistor and a third transistor. A first control apparatus is coupled between the transistors and the dipoles. The first control apparatus comprises three groups of switches.

A convergence control method is applied to the bandgap reference for finding the equilibrium operating point of the first dipole and the second dipole. Under the convergence control method, the current flowing through the second dipole is switched into the first dipole through configuring the on/off of the switches of the first control apparatus.

At step 1002, in a first step of the convergence control method, the first control apparatus coupled between the transistors and the dipoles is configured such that a current flowing through the second transistor flows into the first dipole, a current flowing through the third transistor flows into the second dipole, and a current flowing through the first transistor flows into the third dipole.

At step 1004, in a second step of the convergence control method, the first control apparatus coupled between the transistors and the dipoles is configured such that the current flowing through the third transistor flows into the first dipole, the current flowing through the first transistor flows into the second dipole, and the current flowing through the second transistor flows into the third dipole.

At step 1006, in a third step of the convergence control method, the first control apparatus coupled between the transistors and the dipoles is configured such that the current flowing through the first transistor flows into the first dipole, the current flowing through the second transistor flows into the second dipole, and the current flowing into through the third transistor flows the third dipole.

The first step, the second step and the third step above are applied to the bandgap reference until the equilibrium operating point of the first dipole and the second dipole has been obtained.

It should be noted the method shown in FIG. 10 may be applicable to any bandgap reference having a working point or an equilibrium point which is based on the intersection of the curve-voltage curves of two dipoles.

It should further be noted that method shown in FIG. 10 may be extended to a bandgap reference having three or more input dipoles. The bandgap reference having three or more input dipoles can be controlled through the rotation mechanism described above with respect to FIGS. 4-10.

In operation, when the rotation mechanism is applied to the bandgap structure, a clock signal is also fed into the bandgap structure. At each clock cycle, only one transistor of the current mirror is controlled by the output of the amplifier of the bandgap reference. The gate drive voltages of the other transistors of the current mirror are stored at their respective capacitors (each transistor has a gate-source capacitor).

Figure 11:
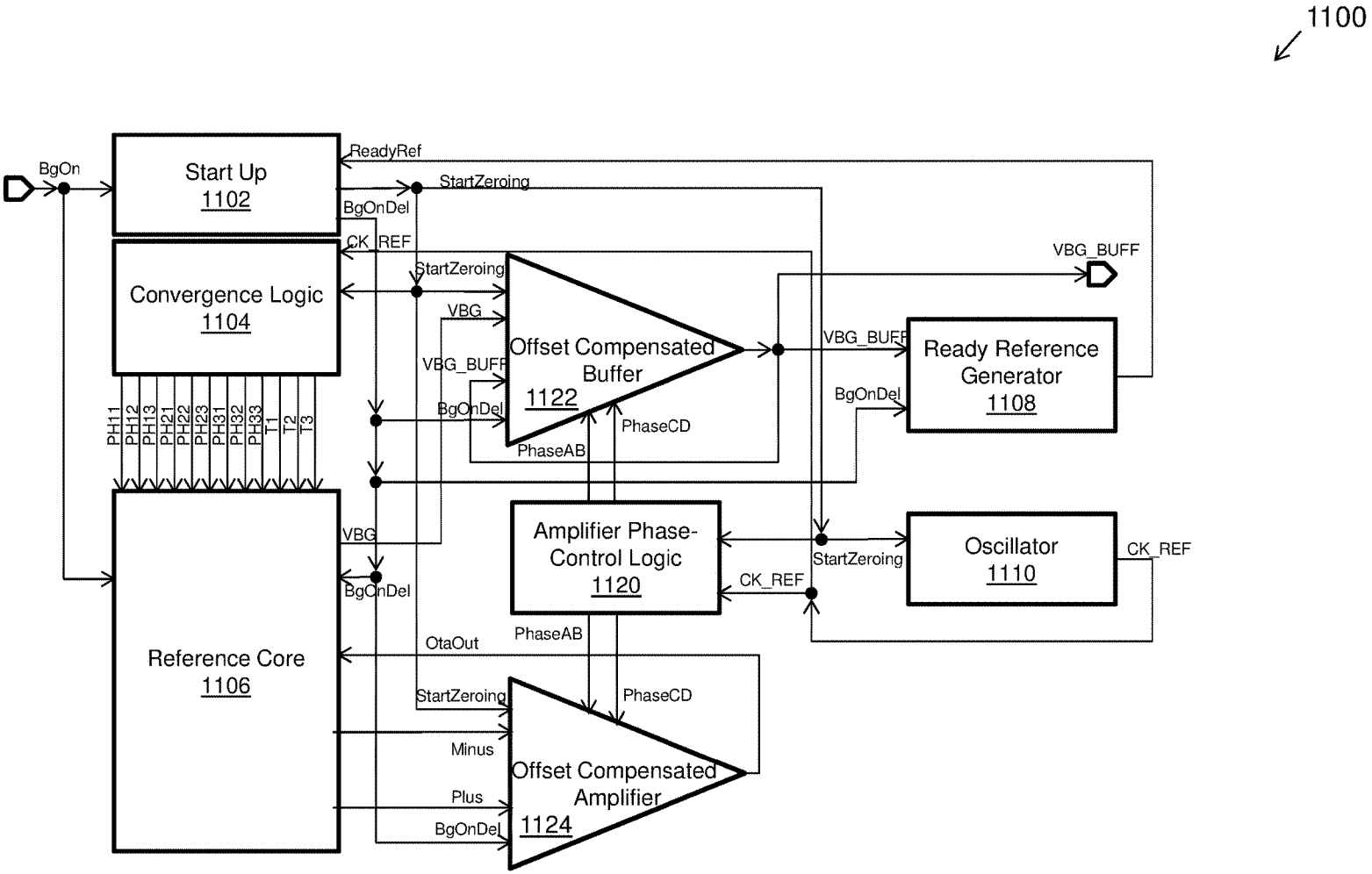
FIG. 11 illustrates a block diagram of a bandgap reference in accordance with various embodiments of the present disclosure.

FIG. 11 illustrates a block diagram of a bandgap reference in accordance with various embodiments of the present disclosure. The bandgap reference 1100 is similar to that shown in FIG. 3 except that additional control circuits have been included.

As shown in FIG. 11, the bandgap reference 1100 comprises a startup block 1102, a convergence logic block 1104, a reference core block 1106, an offset compensated buffer 1122, an amplifier phase-control logic block 1120, an offset compensated amplifier 1124, a ready reference generator 1108 and an oscillator 110.

The startup block 1102 is configured to receive a BgOn signal. Based on the rising edge of the BgOn signal, the startup block 1102 is configured to generate a BgOnDel signal. In some embodiments, the BgOnDel signal is a pulse starting from the rising edge of the BgOn signal.

The startup block 1102 also receives a ReadyRef signal generated by the ready reference generator 1108. The ReadyRef signal is buffered at the startup block 1102. After a predetermined delay, the ReadyRef signal is converted into a StartZeroing signal. As shown in FIG. 11, the StartZeroing signal is fed into the convergence logic block 1104, the offset compensated buffer 1122, the amplifier phase-control logic block 1120, the offset compensated amplifier 1124 and the oscillator 1110. The startup block in a bandgap reference is well known in the art, and hence is not discussed in further detail herein.

The ready reference generator 1108 is configured to receive the BgOnDel signal generated by the startup block 1102, and generate the delayed signal (ReadyRef) based on the BgOnDel signal. In principle, the delay has to include the time needed to turn on the bandgap reference 1100 after almost completing a VBG_BUFF transient of the bandgap reference 1100.

It should be noted that the bandgap reference 1100 operates in two different phases. In a first phase, there is a startup in which no compensation is applied to the bandgap reference 1100. The bandgap reference 1100 may generate a stable state with all offsets. In other words, the currents in transistors MP1, MP2 and MP3 (shown in FIG. 12) are dispersed, and the OTAs are working with their native offsets. The delay described above (ReadyRef) is generated for covering this initial transient part (the VBG_BUFF transient) in order to have a system close to the equilibrium point when the compensation mechanism starts in a second phase.

In the ready reference generator 1108, the delayed signal can be generated in different ways such as a resistor-capacitor analog delay and the like. The ready reference generator 1108 in a bandgap reference is well known in the art, and hence is not discussed in further detail herein.

In some embodiments, the oscillator 1110 is implemented as a low consumption relaxation oscillator. The oscillator 1110 is configured to receive the StartZeroing signal generated by the startup block 1102. The oscillator 1110 starts to oscillate when the StartZeroing signal rises to a logic "1" state. The oscillator 1110 generates a CK_REF signal as shown in Figure ii. The CK_REF signal is fed into the convergence logic block 1104 and the amplifier phase-control logic block 1120. The oscillator in a bandgap reference is well known in the art, and hence is not discussed in further detail herein.

The amplifier phase-control logic block 1120 is configured to receive the CK_REF signal and the StartZeroing signal. Based on these two received signals, the amplifier phase-control logic block 1120 is configured to generate a phase AB signal and a phase CD signal. The phase AB signal and the phase CD signal are fed into the offset compensated buffer 1122 and the offset compensated amplifier 1124 as shown in FIG. 11.

The phase AB signal and the phase CD signal are two complemented clocked signals (opposite phases). The function of these two signals is to drive the switches of the offset compensated amplifier 1124 and the offset compensated buffer 1122. The detailed operating principle of the amplifier phase-control logic block 1120 will be described below with respect to FIG. 16.

The structure and operating principle of the reference core block 1106 will be described below with respect to FIG. 12. The structure and operating principle of the convergence logic block 1104 will be described below with respect to FIGS. 13-15. The structure and operating principle of the offset compensated amplifier 1124 will be described below with respect to FIGS. 16-18. The structure and operating principle of the offset compensated buffer 1122 will be described below with respect to FIG. 19.

In operation, the bandgap reference 1100 is configured to operate in two different phases, namely a startup phase and an offset compensation phase. In the startup phase, after a power on signal is applied to the bandgap reference 1100, the BgOn signal is generated by a suitable circuit such as a power-on reset (POR) circuit. The delayed signal BgOnDel is generated inside the startup block 1102. Both the BgOnDel signal and the BgOn signal are fed into the reference core block 1106. The reference core block 1106 comprises a plurality of p-type transistors and a plurality of dipoles. Referring back to FIG. 3, the plurality of p-type transistors is coupled to the respective dipoles. In the startup phase, the current flowing through each p-type transistor (e.g., MP1) is injected into its corresponding dipole (e.g., DIPOLE_A).

During the startup phase, both the offset compensated amplifier 1124 and the offset compensated buffer 1122 are enabled by the same BgOn signal. During the startup phase, the offset compensation mechanism is not activated. Furthermore, the oscillator 1110 is not activated yet. The signals generated by the amplifier phase-control logic block 1120 and the convergence logic block 1104 are initialized in order to allow the startup of the bandgap reference 1100.

In the offset compensation phase, the ready reference generator 1108 takes into account a sufficient delay to stabilize the bandgap reference 100. After this delay, the StartZeroing signal is changed to a logic high state. The oscillator 100 starts to generate the CK_REF signal, which is a clock signal. In response to the CK_REF signal, both the convergence logic block 1104 and the amplifier phase-control logic block 1120 start to generate their outputs. Under the convergence method described above, the bandgap reference 1100 is configured to generate a temperature stable reference voltage.

Figure 12:
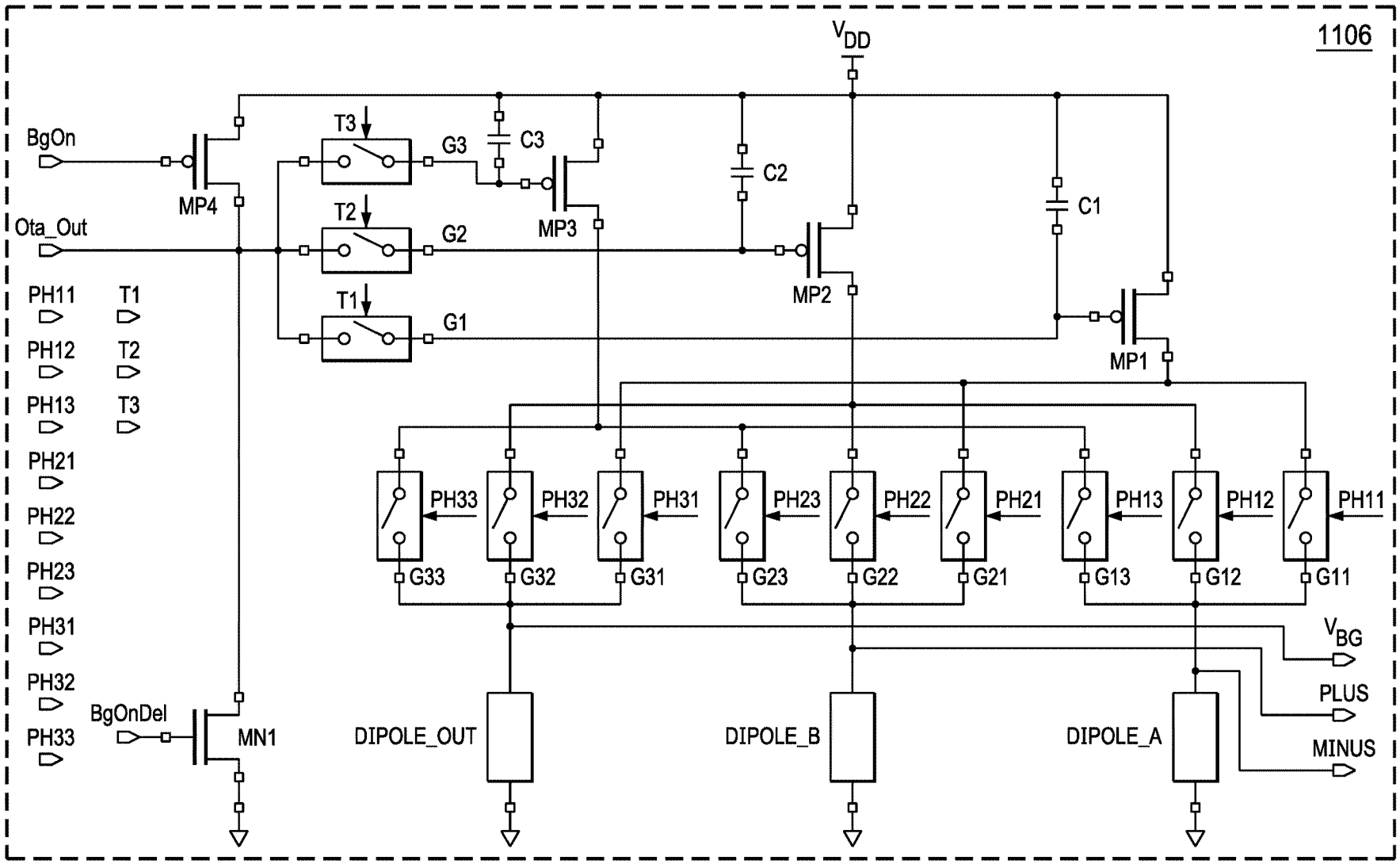
FIG. 12 illustrates a schematic diagram of the reference core block shown in FIG. 11 in accordance with various embodiments of the present disclosure.

FIG. 12 illustrates a schematic diagram of the reference core block shown in FIG. 11 in accordance with various embodiments of the present disclosure. The structure of the reference core block 1106 is similar to that shown in FIG. 3, and hence the identical portions are not discussed herein to avoid repetition.

The reference core block 1106 comprises a plurality of input terminals PH11, PH12, PH13, PH21, PH22, PH23, PH31, PH32, PH33, T1, T2 and T3 as shown in FIG. 12. Referring back to FIG. 11, the input terminals PH11-PH33 and T1-T3 are coupled to the convergence logic block 1104. The convergence logic block 1104 generates the gate drive signals for controlling the switches of the reference core block 1106. The gate drive signals are fed into the reference core block 1106 through the input terminals PH11-PH33 and T1-T3.

The reference core block 1106 further comprises two signal terminals BgOn and BgOnDel as shown in FIG. 12. Referring back to FIG. 11, the signal terminals BgOn and BgOnDel are coupled to an input terminal and the startup block 1102 respectively. As shown in FIG. 12, two transistors MP4 and MN1 are driven by the startup signals BgOn and BgOnDel respectively in order to initialize the output OtaOut of the offset compensated amplifier 1124 shown in FIG. 11. The role of these two transistors is to force the bandgap reference 1100 operating in an initial step with a non-zero current.

The reference core block 1106 further comprises an input terminal Ota_Out, and output terminals $V_{BG}$, Plus and Minus as shown in FIG. 2. Referring back to FIG. 11, the output terminals Plus and Minus are coupled to two inputs of the offset compensated amplifier 1124. The input terminal Ota_Out is coupled to the output of the offset compensated amplifier 1124. The output terminal $V_{BG}$ is coupled to the offset compensated buffer 1122.

Transistors MP1, MP2 and MP3 form a current mirror. The current mirror is employed to impose the same current in the dipoles (e.g., DIPOLE_A, DIPOLE_B and DIPOLE_OUT). The switching elements shown in FIG. 12 are used for implementing a rotation control mechanism exchanging the role of the p-type transistors (MP1, MP2 and MP3), and allowing the convergence to the equilibrium point of DIPOLE_A and DIPOLE_B. The switches (G1-G3, G11-G13, G21-G23 and G31-G33) are driven by controls signals generated from the convergence logic block 1104.

Capacitors C1, C2 and C3 are used to store the gate drive voltages applied to transistors MP1-MP3. The functions of capacitors C1-C3 have been described above with respect to FIGS. 3-9. DIPOLE_OUT is configured to generate a temperature compensated voltage. DIPOLE_A and DIPOLE_B are general dipoles, which have been described above with respect to FIGS. 2-3.

In some embodiments, the current-voltage curves of DIPOLE_A and DIPOLE_B satisfy the following equation:

$$\frac{dI_A}{dV} > \frac{dI_B}{dV} \tag{1}$$

where $I_A$ is the current flowing through DIPOLE_A, and $I_B$ is the current flowing through DIPOLE_B. V is the voltage across DIPOLE_A and DIPOLE_B. It should be noted that the voltage across DIPOLE_A is equal to the voltage across DIPOLE_B.

It should be noted that FIGS. 5, 7 and 9 above show the current-voltage curves of DIPOLE_A and DIPOLE_B satisfy Equation (1).

Figure 13:
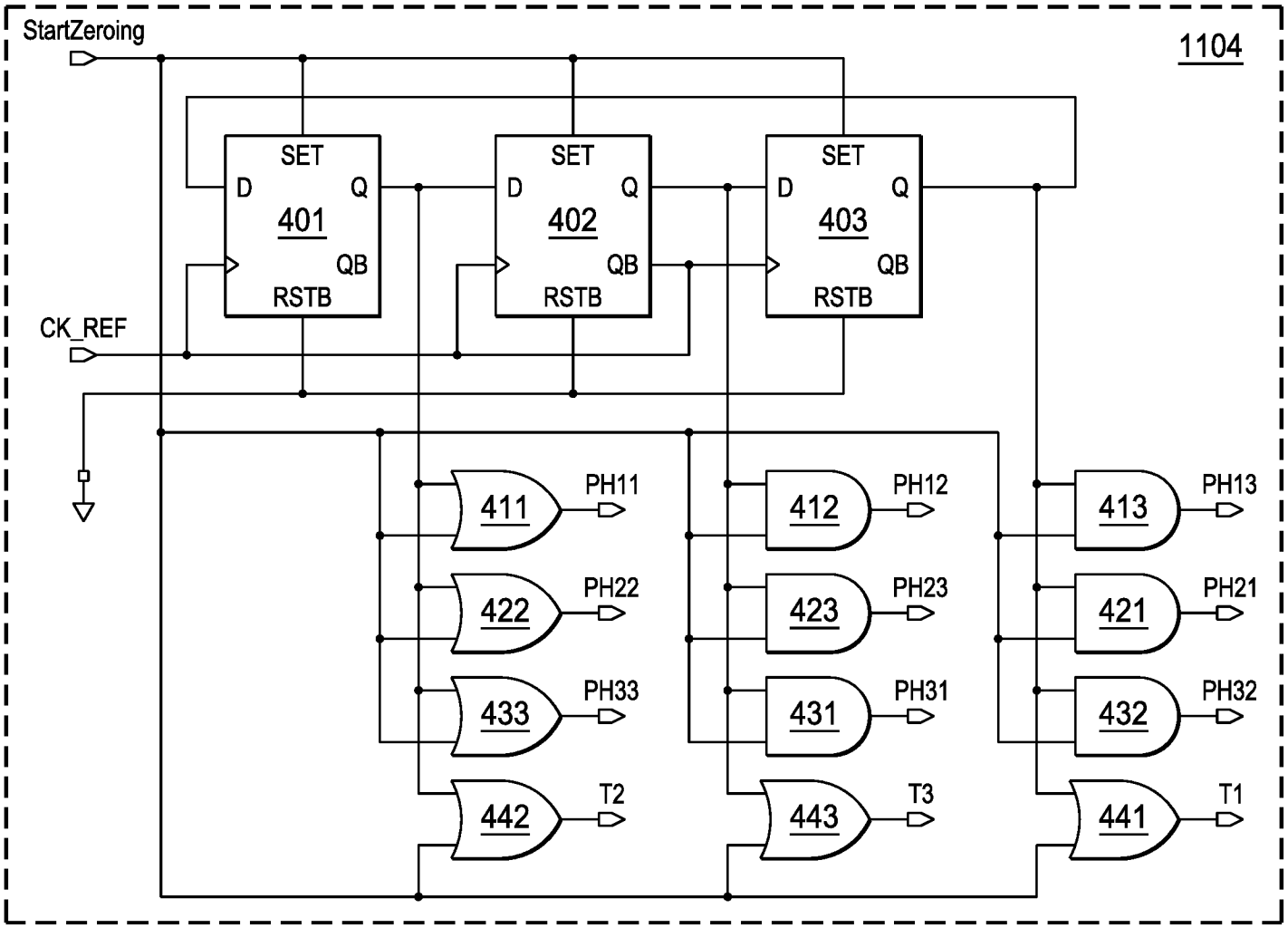
FIG. 13 illustrates a schematic diagram of the convergence logic block shown in FIG. 11 in accordance with various embodiments of the present disclosure.

FIG. 13 illustrates a schematic diagram of the convergence logic block shown in FIG. 11 in accordance with various embodiments of the present disclosure. The convergence logic block 1104 comprises a first latch 401, a second latch 402 and a third latch 403. The convergence logic block 1104 further comprises six OR gates 411, 422, 433, 441, 442 and 443. The convergence logic block 1104 further comprises six AND gates 412, 423, 431, 413, 421 and 432. The operating principles of the latch, the OR gate and the AND gate are well known in the art, and hence are not discussed herein.

The convergence logic block 1104 is configured to receive the StartZeroing signal and the CK_REF signal. Based on the received signals, the convergence logic block 1104 is employed to provide the right sequence of the control signals for controlling all the switching elements (G1-G3, G11-G13, G21-G23 and G31-G33) in the reference core block 1106.

The bandgap reference 1100 is configured to operate in two different phases, namely the startup phase and the offset compensation phase. In the startup phase, signals T1, T2 and T3 drive their respective switches to a normally on state (switches T1-T3 are closed). This allows the normal startup with an initial current in all the p-type transistors of the current mirror.

In the offset compensation phase, the StartZeroing signal has a transition from a logic low state to a logic high state in response to this phase change. The oscillator 1110 starts to generate the CK_REF signal in response the transition of the StartZeroing signal allowing the evolution of the logic outputs. At each clock cycle, the role of the p-type transistors of the current mirror is exchanged. This helps to compensate the offsets of the current mirror. Through the convergence control method described above, both dipoles (DIPOLE_A and DIPOLE_B) operate at the equilibrium point to reduce the impact of the offsets of the current mirror.

Figure 14:
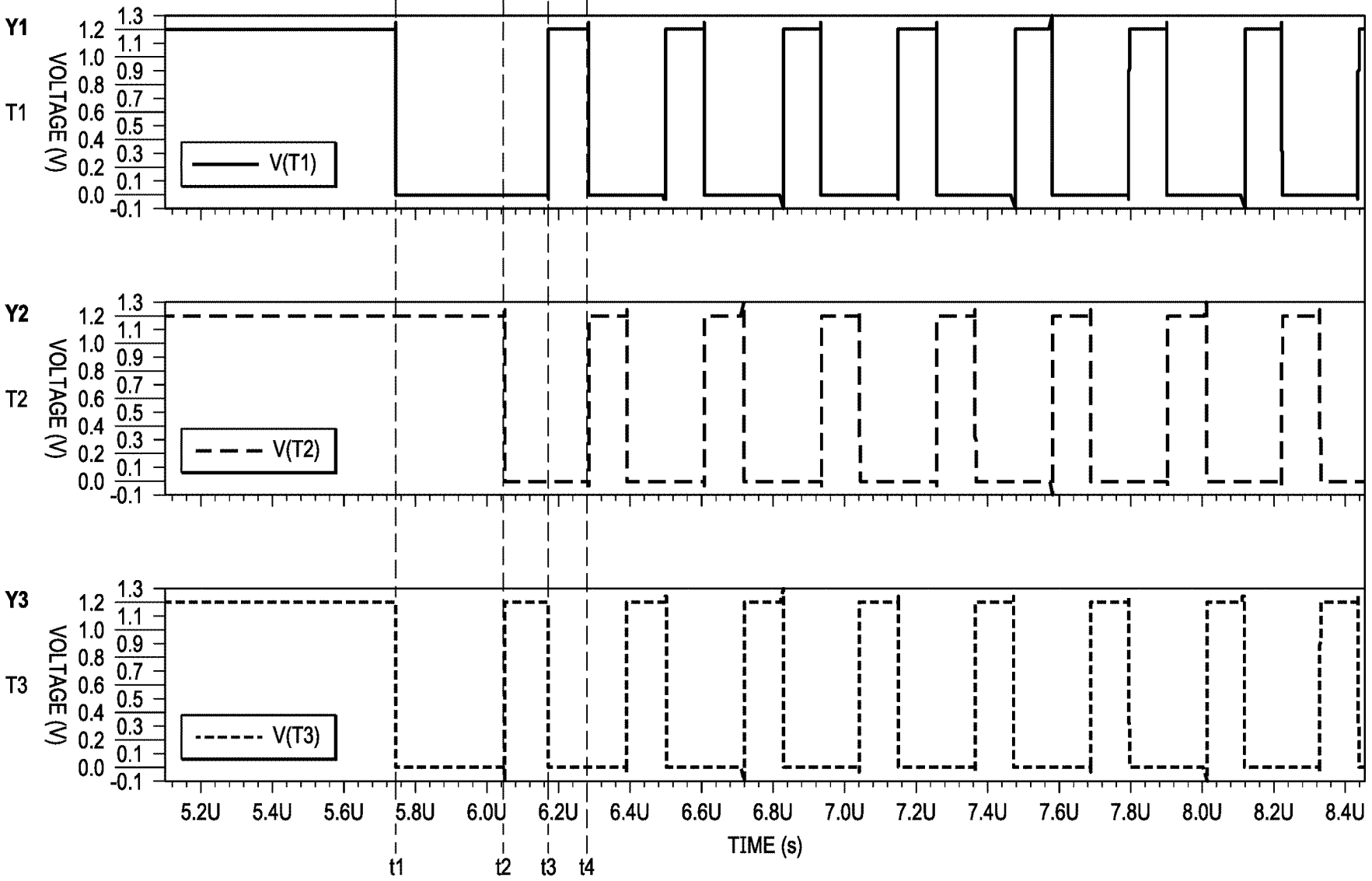
FIG. 14 illustrates p-type transistor gate drive waveforms generated by the convergence logic block shown in FIG. 13 in accordance with various embodiments of the present disclosure.

FIG. 14 illustrates p-type transistor gate drive waveforms generated by the convergence logic block shown in FIG. 13 in accordance with various embodiments of the present disclosure. The horizontal axis of FIG. 14 represents intervals of time. There are three vertical axes. The first vertical axis Y1 represents the waveform of the gate drive signal T1. The second vertical axis Y2 represents the waveform of the gate drive signal T2. The third vertical axis Y3 represents the waveform of the gate drive signal T3.

Referring back to FIG. 13, the gate drive signal T1 is employed to control the switch G1 placed between the output of the amplifier and the gate of transistor MP1. The gate drive signal T2 is employed to control the switch G2 placed between the output of the amplifier and the gate of transistor MP2. The gate drive signal T3 is employed to control the switch G3 placed between the output of the amplifier and the gate of transistor MP3.

Prior to a first time instant t1, the bandgap reference 1100 operates in the startup phase, T1, T2 and T3 are of a logic high state. After t1, the bandgap reference operates in the offset compensation phase. From t1 to t2, T2 is of a logic high state, and T1 and T3 are of a logic low state as shown in FIG. 14. Since T2 is of a logic high state, transistor MP2 is driven by the output of the amplifier (Ota_Out). Transistors MP1 and MP3 are biased by their respective capacitors (C1 and C3). From t2 to t3, T3 is of a logic high state, and T1 and T2 are of a logic low state as shown in FIG. 14. Since T3 is of a logic high state, transistor MP3 is driven by the output of the amplifier (Ota_Out). Transistors MP1 and MP2 are biased by their respective capacitors (C1 and C2). From t3 to t4, T1 is of a logic high state, and T2 and T3 are of a logic low state as shown in FIG. 14. Since T1 is of a logic high state, transistor MP1 is driven by the output of the amplifier (Ota_Out). Transistors MP2 and MP3 are biased by their respective capacitors (C2 and C3). In the following clock cycles, the role of MP1, MP2 and MP3 is rotating as shown in FIG. 14.

Figure 15:
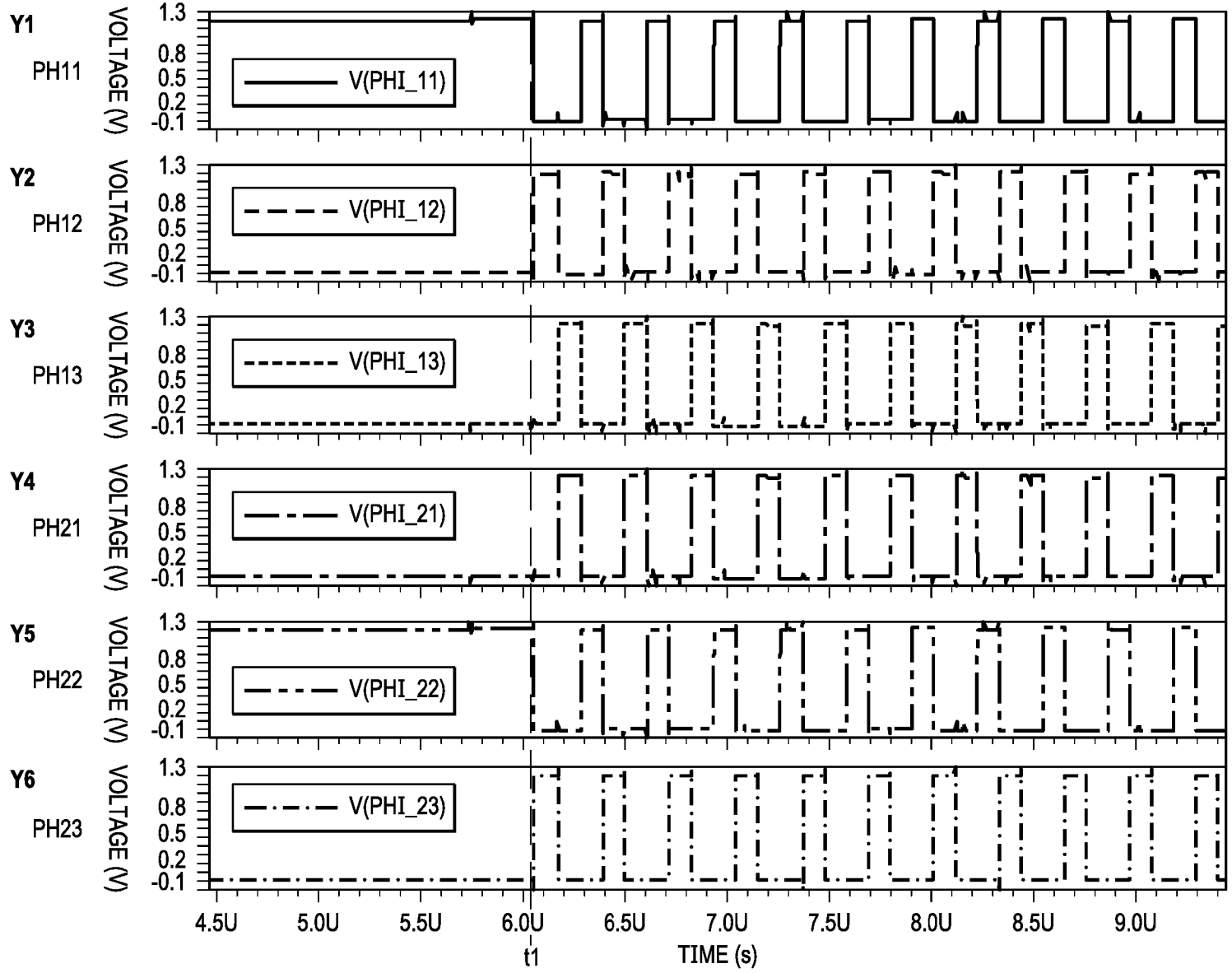
FIG. 15 illustrates various gate drive signals generated by the convergence logic block shown in FIG. 13 in accordance with various embodiments of the present disclosure.

FIG. 15 illustrates various gate drive signals generated by the convergence logic block shown in FIG. 13 in accordance with various embodiments of the present disclosure. The horizontal axis of FIG. 15 represents intervals of time. There are six vertical axes. The first vertical axis Y1 represents the waveform of the gate drive signal PH11. The second vertical axis Y2 represents the waveform of the gate drive signal PH12. The third vertical axis Y3 represents the waveform of the gate drive signal PH13. The fourth vertical axis Y4 represents the waveform of the gate drive signal PH21. The fifth vertical axis Y5 represents the waveform of the gate drive signal PH22. The sixth vertical axis Y6 represents the waveform of the gate drive signal PH23.

Referring back to FIG. 12, the gate drive signal PH11 is employed to control the on/off of switch G11. The gate drive signal PH12 is employed to control the on/off of switch G12. The gate drive signal PH13 is employed to control the on/off of switch G13. The gate drive signal PH21 is employed to control the on/off of switch G21. The gate drive signal PH22 is employed to control the on/off of switch G22. The gate drive signal PH23 is employed to control the on/off of switch G23.

Prior to the first time instant t1, the bandgap reference 1100 operates in the startup phase. PH11 and PH22 are of a logic high state. After t1, the bandgap reference operates in the offset compensation phase.

In the offset compensation phase, the gate drive signals satisfy the following rotation rules:

$$PH_{II}=PH_{I+1I+1} \tag{2}$$

$$PH_{IJ}=PH_{I+1,J+1} \tag{3}$$

where I and J are in a range from 1 to 3. When I+1 is greater than 3, the index is reset to 1. Likewise, when J+1 is greater than 3, the index is reset to 1. For example, $PH_{11}=PH_{22}$, and $PH_{13}=PH_{21}$ as shown in FIG. 15.

Figure 16:
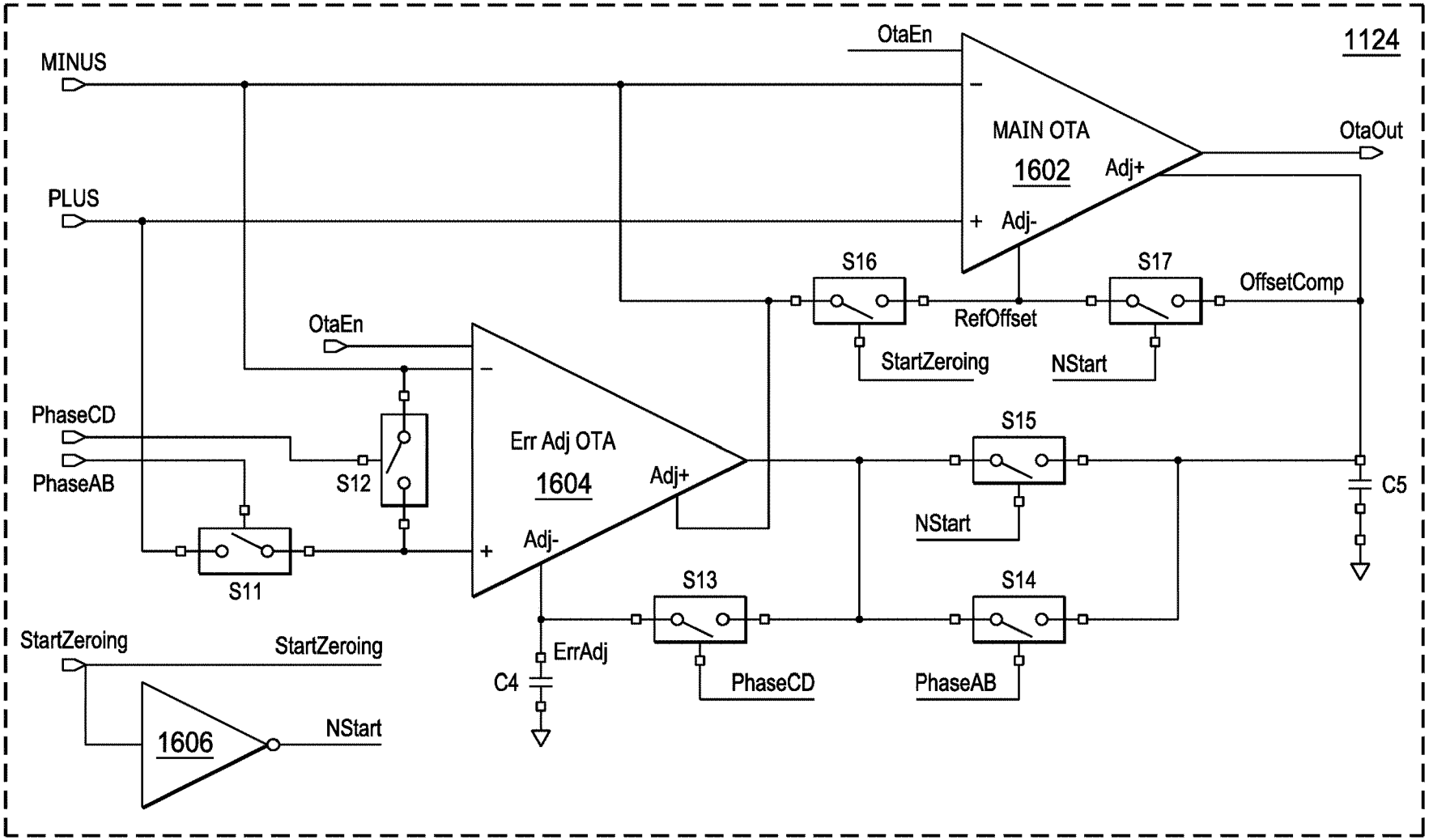
FIG. 16 illustrates a schematic diagram of the offset compensated amplifier shown in FIG. 11 in accordance with various embodiments of the present disclosure.

FIG. 16 illustrates a schematic diagram of the offset compensated amplifier shown in FIG. 11 in accordance with various embodiments of the present disclosure. The offset compensated amplifier 1124 comprises a main operational transconductance amplifier (OTA) 1602 and an error adjustment OTA 1604. The main OTA 1602 has an inverting input coupled to the Minus node, and a non-inverting input coupled to the Plus node as shown in FIG. 16. The main OTA 1602 has two secondary inputs. A first secondary input Adj+ of the main OTA 1602 is coupled to a node OffsetComp. A second secondary input Adj− of the main OTA 1602 is coupled to a node RefOffset. The node OffsetComp is coupled to the node RefOffset through switch S17. As shown in FIG. 16, switch S17 is controlled by the signal NStart. The RefOffset node is coupled to the Minus node through switch S16. As shown in FIG. 16, switch S16 is controlled by the signal StartZeroing.

The error adjustment OTA 1604 has an inverting input coupled to the Minus node, and a non-inverting input coupled to the Plus node as shown in FIG. 16. The error adjustment OTA 1604 has two secondary inputs. A first secondary input Adj+ of the error adjustment OTA 1604 is coupled to the node Minus. A second secondary input Adj− of the error adjustment OTA 1604 is coupled to a node ErrAdj. The node ErrAdj is coupled to the output of the error adjustment OTA 1604 through switch S13. As shown in FIG. 16, switch S13 is controlled by the Phase CD signal. The output of the error adjustment OTA 1604 is coupled to the OffsetComp node through switches S14 and S15. As shown in FIG. 16, switches S14 and S15 are coupled in parallel. Switch S14 is controlled by the Phase AB signal. Switch S15 is controlled by the NStart signal.

FIG. 16 further illustrates a capacitor C4 coupled between the node ErrAdj and ground, and a capacitor C5 coupled between the node OffsetComp and ground. An inverter 1606 is configured to receive the StartZeroing signal and convert this signal into the NStart signal. An enable signal OtaEn is employed to control the main OTA 1602 and the error adjustment OTA 1604.

Referring back to FIG. 11, the amplifier phase-control logic block 1120 is configured to generate the phase AB signal and the phase CD signal. The phase AB signal and the phase CD signal are fed into the offset compensated amplifier 1124. The phase AB signal and the phase CD signal are two complemented clocked signals. The function of these two signals is to drive the switches (e.g., S11, S12, S13 and S14) of the offset compensated amplifier 1124.

In operation, during the offset compensation phase, the offset compensated amplifier 1124 is configured to operate in two different operating modes. In a first operating mode, the phase AB signal is logic low and the phase CD signal is logic high. The offset compensated amplifier 1124 operates in an amplifier offset compensation mode. In the amplifier offset compensation mode, the switch S11 is turned off and the switch S12 is turned on. As a result of turning on the switch S12, the primary inputs of the error adjustment OTA 1604 are shorted. The switch S13 is turned on and the switch S14 is turned off. The secondary input Adj− is closed in loop with the output of the error adjustment OTA 1604, and the secondary input Adj+ is used as reference input. In this way, the error adjustment OTA 1604 imposes an amplifier offset compensation voltage that is stored in the capacitor C4.

In a second operating mode, the phase AB signal is logic high and the phase CD signal is logic low. The switches S12 and S13 are turned off. The switches S11 and S14 are turned on. The error adjustment OTA 1604 is offset compensated. The error adjustment OTA 1604 is used to compensate the offset of the main OTA 1602. The compensation voltage is stored in the capacitor C5.

In some embodiments, the main OTA 1602 is configured to operate in a continuous mode. The secondary inputs Adj+ and Adj− of the main OTA 1602 are employed to provide an offset adjustment. Referring back to FIGS. 11 and 12, the Minus input of the offset compensated amplifier 1124 is coupled to DIPOLE_A. The Minus input is used to establish a reference point for both the error adjustment OTA 1604 and Main OTA 1602.

In the startup phase, the inverting input and the non-inverting input of the error adjustment OTA 1604 are shorted. The secondary input Adj− of the main OTA 1602 is shorted with the output of the error adjustment OTA 1604. C4 is charged by the output of the error adjustment OTA 1604 to a value close to the voltage on the node Minus. In the startup phase, the NStart signal is of a logic high state. The switches S15 and S17 are turned on. In response to the turn-on of S17, the secondary inputs Adj+ and Adj− of the main OTA 1602 are shorted. In response to the turn-on of S15, the secondary inputs Adj+ and Adj− of the main OTA 1602 are coupled to the output of the error adjustment OTA 1604. The nodes RefOffset and OffsetComp are shorted, and charged by the output of the error adjustment OTA 1604 to a value close to the voltage on the node Minus.

In the offset compensation phase, the StartZeroing signal is of a logic high state. The switches S16 is turned on. The nodes RefOffset is coupled to Minus. The voltage on the node ErrAdj is equal to the offset compensation voltage. This voltage is stored in C4. The voltage on the node OffsetComp is driven by the output of the error adjustment OTA 1604. The voltage on the node OffsetComp is stored in C5.

During the offset compensation phase, the Phase AB signal and the Phase CD signal are applied to the offset compensated amplifier 1124. When the Phase AB signal is of a logic low state and the Phase CD signal is of a logic high state, switches S11 and S14 are turned off (open), and switches S12 and S13 are turned on (closed). The amplifier offset compensation voltage is refreshed and stored in capacitor C4. In a following clock cycle, the Phase AB signal is of a logic high state and the Phase CD signal is of a logic low state. Switches S11 and S14 are turned on (closed), and switches S12 and S13 are turned off (open). The offset compensation of the main OTA 1602 is refreshed.

In the startup phase, it is fundamental to charge the reference capacitors (e.g., C5 and C4) of the main OTA 1602 and the error adjustment OTA 1604. The charged values of the reference capacitors must be close enough to the working points of the main OTA 1602 and the error adjustment OTA 1604. In some embodiments, the reference capacitors are charged to a value close to the voltage on the node Minus. The node Minus is a low impedance node and the voltage on this node is stable during transients.

It should be noted that capacitors C4 and C5 cannot be loaded directly because loading C4 and C5 directly may cause a long startup process. In some embodiments, capacitors C4 and C5 are charged by the error adjustment OTA 1604. The error adjustment OTA 1604 helps to speed up the charging process of capacitors C4 and C5.

Figure 17:
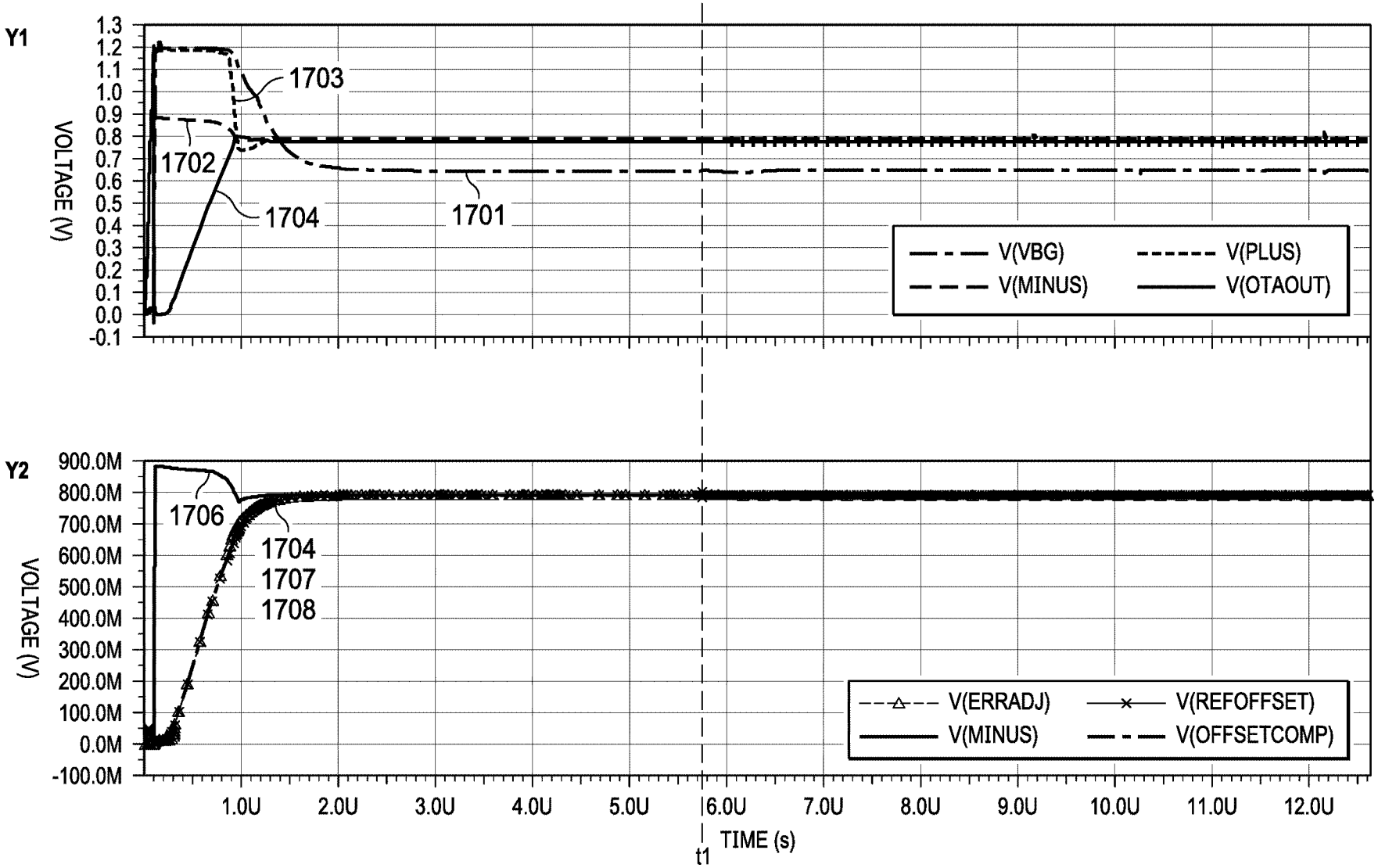
FIG. 17 illustrates various waveforms of the offset compensated amplifier shown in FIG. 16 in accordance with various embodiments of the present disclosure.

FIG. 17 illustrates various waveforms of the offset compensated amplifier shown in FIG. 16 in accordance with various embodiments of the present disclosure. The horizontal axis of FIG. 17 represents intervals of time. There are two vertical axes. The first vertical axis Y1 represents the signals of $V_{BG}$, Minus, Plus and OtaOut. The second vertical axis Y2 represents the signals on the nodes ErrAdj, Minus, RefOffset and OffsetComp.

A first waveform 1701 is the signal of $V_{BG}$ (shown in FIG. 11). A second waveform 1702 is the signal on the node Minus (shown in FIG. 16). A third waveform 1703 is the signal on the node Plus (shown in FIG. 16). A fourth waveform 1704 is the signal on the node OtaOut (shown in FIG. 16). A fifth waveform 1705 is the signal on the node ErrAdj. A sixth waveform 1706 is the signal on the node Minus. A seventh waveform 1707 is the signal on the node RefOffset (shown in FIG. 16). An eighth waveform 1708 is the signal on the node OffsetComp (shown in FIG. 16).

Prior to the first time instant t1, the bandgap reference 1100 operates in the startup phase. After t1, the bandgap reference operates in the offset compensation phase. During the startup phase, OtaOut is charged to a value close to the voltage on the node Minus. The value of Plus is equal to the value of Minus after the OTAs have been stabilized. During the startup phase, ErrAdj, RefOffset and OffsetComp are charged to a value close to the voltage on the node Minus after the OTAs have been stabilized.

Figure 18:
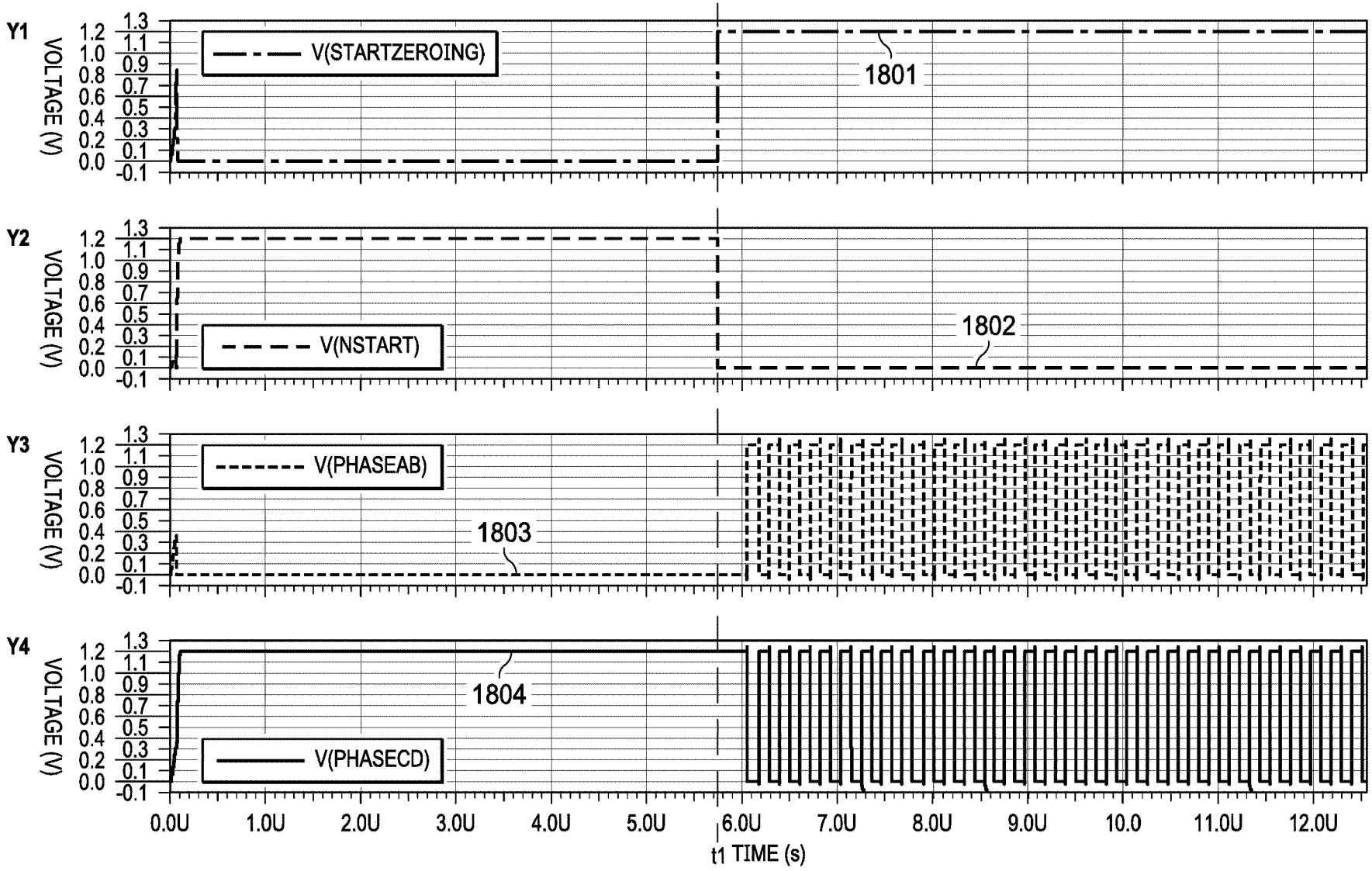
FIG. 18 illustrates other waveforms of the offset compensated amplifier shown in FIG. 16 in accordance with various embodiments of the present disclosure.

FIG. 18 illustrates other waveforms of the offset compensated amplifier shown in FIG. 16 in accordance with various embodiments of the present disclosure. The horizontal axis of FIG. 18 represents intervals of time. There are four vertical axes. The first vertical axis Y1 represents the signal of StartZeroing. The second vertical axis Y2 represents the signal of Nstart. The third vertical axis Y3 represents the phase AB signal. The fourth vertical axis Y4 represents the phase CD signal.

A first waveform 18*oi* is the signal of startzeroing. A second waveform 1802 is the signal of Nstart. A third waveform 1803 is the phase AB signal. A fourth waveform 1804 is the phase CD signal.

Prior to the first time instant t1, the bandgap reference 1100 operates in the startup phase. After t1, the bandgap reference operates in the offset compensation phase. During the startup phase, both the current mirror offset compensation mechanism and the amplifier offset compensation mechanism are not activated. In addition, the oscillator is not activated. During the offset compensation phase, the Phase AB signal and the Phase CD signal are applied to the offset compensated amplifier as shown in FIG. 18.

Figure 19:
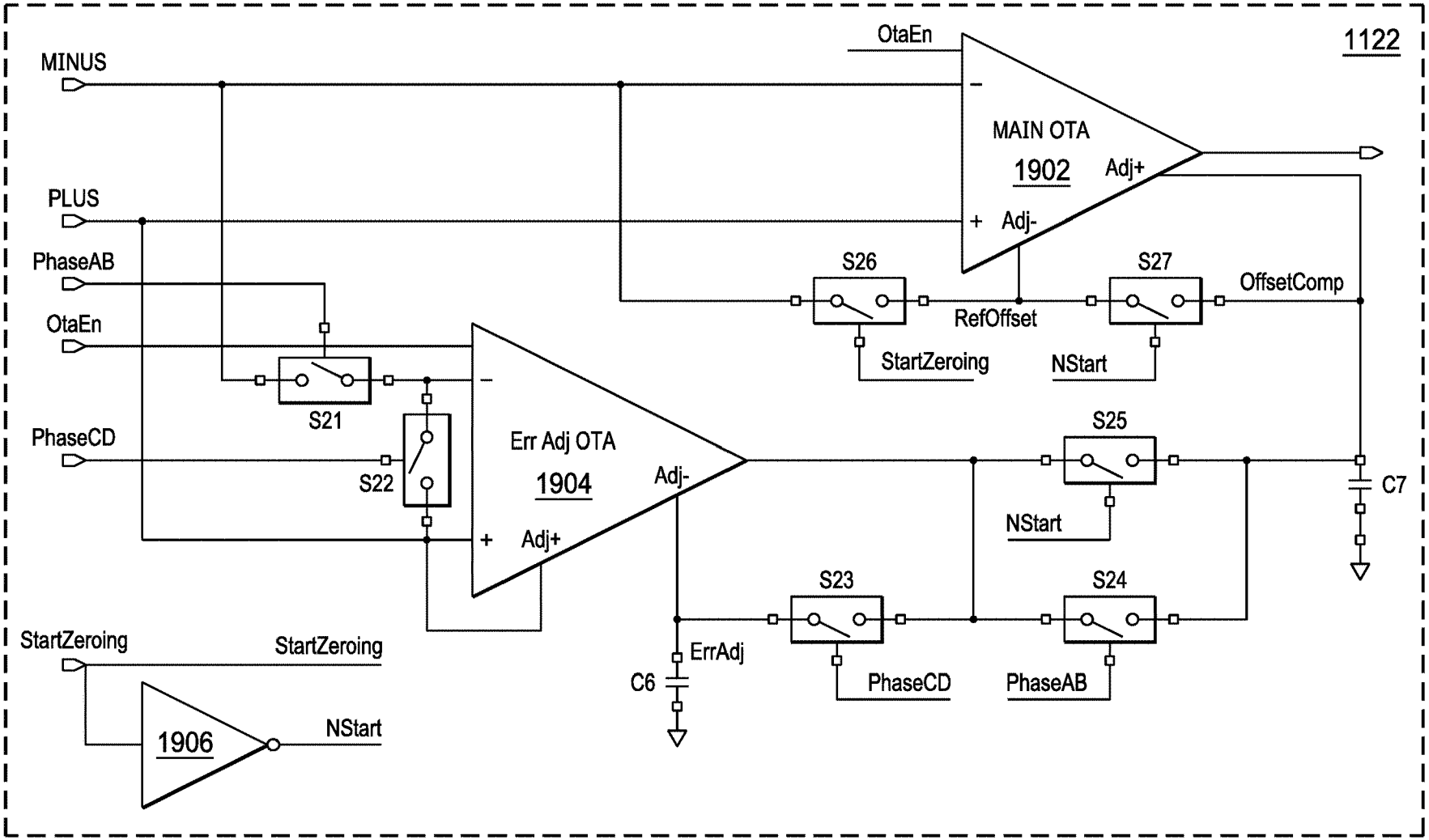
FIG. 19 illustrates a schematic diagram of the offset compensated buffer shown in Figure ni in accordance with various embodiments of the present disclosure.

FIG. 19 illustrates a schematic diagram of the offset compensated buffer shown in FIG. 11 in accordance with various embodiments of the present disclosure. The offset compensated buffer 1122 is similar to the offset compensated amplifier 1124 shown in FIG. 16 except that the internal node connection is different due to the lack of an inverting stage. The external signals and the switch configuration of the offset compensated buffer 1122 are similar to those of the offset compensated amplifier 1124 shown in FIG. 16, and hence are not discussed herein.

Although embodiments of the present disclosure and its advantages have been described in detail, it should be understood that various changes, substitutions and alterations can be made herein without departing from the spirit and scope of the disclosure as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An apparatus for generating a bandgap reference voltage, comprising:

a current mirror coupled to an output of an amplifier through control switches;

a plurality of capacitors, each of which is coupled between a bias voltage and a control gate of a leg of the current mirror and further coupled to the output of the amplifier through a corresponding control switch;

a first dipole coupled to a first input of the amplifier;

a second dipole coupled to a second input of the amplifier;

a third dipole coupled to an output of the apparatus configured to generate the bandgap reference voltage; and groups of switches coupled between the current mirror and the dipoles.

2. The apparatus of claim 1, wherein:

the current mirror comprises a first transistor, a second transistor and a third transistor, and wherein:

a first drain/source terminal of the first transistor, a first drain/source terminal of the second transistor and a first drain/source terminal of the third transistor are coupled to a same voltage potential;

a gate of the first transistor is coupled to the output of the amplifier through a first control switch;

a gate of the second transistor is coupled to the output of the amplifier through a second control switch; and a gate of the third transistor is coupled to the output of the amplifier through a third control switch.

3. The apparatus of claim 2, wherein the groups of switches include a first group of switches, a second group of switches and a third group of switches, and wherein:

the first group of switches comprises a first switch, a second switch and a third switch, and wherein:

a first terminal of the first switch, a first terminal of the second switch and a first terminal of the third switch are coupled together and further coupled to the first dipole; and a second terminal of the first switch is coupled to a second drain/source terminal of the first transistor;

a second terminal of the second switch is coupled to a second drain/source terminal of the second transistor; and a second terminal of the third switch is coupled to a second drain/source terminal of the third transistor;

the second group of switches comprises a fourth switch, a fifth switch and a sixth switch, and wherein:

a first terminal of the fourth switch, a first terminal of the fifth switch and a first terminal of the sixth switch are coupled together and further coupled to the second dipole; and a second terminal of the fourth switch is coupled to the second drain/source terminal of the first transistor;

a second terminal of the fifth switch is coupled to the second drain/source terminal of the second transistor; and a second terminal of the sixth switch is coupled to the second drain/source terminal of the third transistor; and the third group of switches comprises a seventh switch, an eighth switch and a ninth switch, and wherein:

a first terminal of the seventh switch, a first terminal of the eighth switch and a first terminal of the ninth switch are coupled together and further coupled to the third dipole; and a second terminal of the seventh switch is coupled to the second drain/source terminal of the first transistor;

a second terminal of the eighth switch is coupled to the second drain/source terminal of the second transistor; and a second terminal of the ninth switch is coupled to the second drain/source terminal of the third transistor.

4. The apparatus of claim 2, wherein:

a first capacitor of the plurality of capacitors is coupled between the gate of the first transistor and the first drain/source terminal of the first transistor;

a second capacitor of the plurality of capacitors is coupled between the gate of the second transistor and the first drain/source terminal of the second transistor; and a third capacitor of the plurality of capacitors is coupled between the gate of the third transistor and the first drain/source terminal of the third transistor.

5. The apparatus of claim 1, wherein:

the control switches and the groups of switches are configured to cancel out offsets of the current mirror.

6. The apparatus of claim 1, wherein:

the first dipole comprises a first resistor and a first diode-connected bipolar transistor coupled in parallel;

the second dipole comprises a second resistor and a second diode-connected bipolar transistor coupled in serious and further coupled in parallel with a third resistor; and the third dipole comprises a fourth resistor, and wherein a transistor area of the second diode-connected bipolar transistor is N times greater than a transistor area of the first diode-connected bipolar transistor, and wherein N is greater than 1.

7. The apparatus of claim 6, wherein:

a current flowing through the second resistor is proportional to a difference between a first base-emitter voltage of the first diode-connected bipolar transistor and a second base-emitter voltage of the second diode-connected bipolar transistor, and wherein the current flowing through the second resistor is proportional to absolute temperature; and a current flowing through the third resistor is proportional to the first base-emitter voltage of the first diode-connected bipolar transistor, and wherein the current flowing through the third resistor is complementary to absolute temperature.

8. A device comprising:

a first dipole coupled to a first transistor, a second transistor and a third transistor through a first group of switches;

a second dipole coupled to the first transistor, the second transistor and the third transistor through a second group of switches;

a third dipole coupled to the first transistor, the second transistor and the third transistor through a third group of switches;

an amplifier having an inverting input directly connected to a common node of the first group of switches and the first dipole, and a non-inverting input directly connected to a common node of the second group of switches and the second dipole; and a control apparatus comprising a plurality of auxiliary switches coupled between an output of the amplifier and gates of the first transistor, the second transistor and the third transistor.

9. The device of claim 8, wherein:

the first transistor, the second transistor and the third transistor are p-type transistors; and the first transistor, the second transistor and the third transistor form a current mirror.

10. The device of claim 8, wherein the control apparatus comprises:

a first auxiliary switch coupled between the output of the amplifier and a gate of the first transistor;

a second auxiliary switch coupled between the output of the amplifier and a gate of the second transistor;

a third auxiliary switch coupled between the output of the amplifier and a gate of the third transistor;

a first capacitor coupled between the gate of the first transistor and a source of the first transistor;

a second capacitor coupled to the gate of the second transistor and a source of the second transistor; and a third capacitor coupled to the gate of the third transistor and a source of the third transistor.

11. The device of claim 8, wherein:

the first dipole is coupled to an inverting input of the amplifier; and the second dipole is coupled to a non-inverting input of the amplifier.

12. The device of claim 8, wherein:

the third dipole comprises a resistor.

13. The device of claim 12, wherein:

a source of the first transistor, a source of the second transistor and a source of the third transistor are coupled together; and the first group of switches comprises a first switch, a second switch and a third switch, and wherein:

a first terminal of the first switch, a first terminal of the second switch and a first terminal of the third switch are coupled together and further coupled to the first dipole; and a second terminal of the first switch is coupled to a drain of the first transistor;

a second terminal of the second switch is coupled to a drain of the second transistor; and a second terminal of the third switch is coupled to a drain of the third transistor;

the second group of switches comprises a fourth switch, a fifth switch and a sixth switch, and wherein:

a first terminal of the fourth switch, a first terminal of the fifth switch and a first terminal of the sixth switch are coupled together and further coupled to the second dipole; and a second terminal of the fourth switch is coupled to the drain of the first transistor;

a second terminal of the fifth switch is coupled to the drain of the second transistor; and a second terminal of the sixth switch is coupled to the drain of the third transistor; and the third group of switches comprises a seventh switch, an eighth switch and a ninth switch, and wherein:

a first terminal of the seventh switch, a first terminal of the eighth switch and a first terminal of the ninth switch are coupled together and further coupled to the third dipole; and a second terminal of the seventh switch is coupled to the drain of the first transistor;

a second terminal of the eighth switch is coupled to the drain of the second transistor; and a second terminal of the ninth switch is coupled to the drain of the third transistor.

14. A method of controlling a bandgap reference comprising a first transistor, a first dipole, a second transistor, a second dipole, a third transistor and a third dipole, the method comprising:

in a first step, configuring a first control apparatus coupled between the transistors and the dipoles such that:

a current flowing through the second transistor flows into the first dipole;

a current flowing through the third transistor flows into the second dipole; and a current flowing through the first transistor flows the third dipole;

in a second step, configuring the first control apparatus coupled between the transistors and the dipoles such that:

the current flowing through the third transistor flows into the first dipole;

the current flowing through the first transistor flows into the second dipole; and the current flowing through the second transistor flows the third dipole;

in a third step, configuring the first control apparatus coupled between the transistors and the dipoles such that:

the current flowing through the first transistor flows into the first dipole;

the current flowing through the second transistor flows into the second dipole; and the current flowing through the third transistor flows the third dipole; and iterating the first step, the second step and the third step, wherein the second step is executed immediately after the first step, and the third step is executed immediately after the second step.

15. The method of claim 14, further comprising:

in an initial step prior to the first step, configuring the first dipole of the bandgap reference to be coupled to the first transistor, the second dipole of the bandgap reference to be coupled to the second transistor, and the third dipole of the bandgap reference to be coupled to the third transistor.

16. The method of claim 14, wherein:

the first dipole is coupled to an inverting input of an amplifier;

the second dipole is coupled to a non-inverting input of the amplifier; and the third dipole is coupled to an output of the amplifier through the third transistor.

17. The method of claim 14, wherein:

the first control apparatus comprises a first group of switches, a second group of switches and a third group of switches, and wherein:

the first group of switches is configured such that the first dipole is coupled to one of the first transistor, the second transistor and the third transistor through turning on one corresponding switch of the first group of switches;

the second group of switches is configured such that the second dipole is coupled to one of the first transistor, the second transistor and the third transistor through turning on one corresponding switch of the second group of switches; and the third group of switches is configured such that the third dipole is coupled to one of the first transistor, the second transistor and the third transistor through turning on one corresponding switch of the third group of switches.

18. The method of claim 14, further comprising:

a second control apparatus coupled between an output of an amplifier and gates of the first transistor, the second transistor and the third transistor.

19. The method of claim 18, wherein the second control apparatus comprises:

a first switch coupled between the output of the amplifier and a gate of the first transistor;

a second switch coupled between the output of the amplifier and a gate of the second transistor;

a third switch coupled between the output of the amplifier and a gate of the third transistor;

a first capacitor coupled to the gate of the first transistor;

a second capacitor coupled to the gate of the second transistor; and a third capacitor coupled to the gate of the third transistor.

20. The method of claim 19, further comprising:

configuring the first switch, the second switch and the third switch such that at least one transistor of the first transistor, the second transistor and the third transistor is driven by the output of the amplifier so that a current flowing through the at least one transistor satisfies a current-voltage curve of the second dipole.

* * * * *